US006332754B1

(12) United States Patent
Matsuda et al.

(10) Patent No.: US 6,332,754 B1
(45) Date of Patent: Dec. 25, 2001

(54) STEAM TURBINE

(75) Inventors: Minoru Matsuda, Yokohama; Masataka Kikuchi, Chigasaki; Nobuo Okita, Ushiku; Kouichi Kitaguchi, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/541,622

(22) Filed: Apr. 3, 2000

(30) Foreign Application Priority Data

Apr. 2, 1999 (JP) ..... 11-097083

(51) Int. Cl.[7] ..... F01D 1/02
(52) U.S. Cl. ..... 415/191; 415/199.5
(58) Field of Search ..... 415/199.5, 199.4, 415/200, 211.2, 100, 102, 103, 101, 213.1, 191, 195, 216.1, 221, 229

(56) References Cited

U.S. PATENT DOCUMENTS 6,203,274 * 3/2001 Kikuchi et al. ..... 415/191

FOREIGN PATENT DOCUMENTS 3-130502 6/1991 (JP) .
10-184306 7/1998 (JP) .

OTHER PUBLICATIONS

T. Fujita, Technical Information Magazine (Mitsubishi Jyuko Giho), vol. 17, No. 2, pp. 109 to 115, "Development and Design Features of Single Cylinder Reheat Turbine Plant", Mar., 1980 (whit English Abstract).

* cited by examiner

*Primary Examiner*—Edward K. Look
*Assistant Examiner*—James M McAleenan
(74) *Attorney, Agent, or Firm*—Oblon, Spivak, McClelland, Maier & Neustadt, P.C.

(57) ABSTRACT

A steam turbine comprises, in combination, at least two of a high pressure turbine section, an intermediate pressure turbine section and a low pressure turbine section in a single turbine casing and the steam turbine generally satisfies such design requirements as: a main steam pressure of 100 kg/cm$^2$ or more; a main steam temperature of 500° C. or more; a rated output (power) of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more. In such steam turbine, a turbine exhaust chamber of the low pressure turbine section has a structure extending towards both sides of a transverse direction of the turbine casing, towards the upper side thereof or in the axial direction thereof.

11 Claims, 20 Drawing Sheets

STEAM TURBINE

BACKGROUND OF THE INVENTION

The present invention relates to a steam turbine in which at least two turbine sections, in combination, selected from a high pressure turbine section, an intermediate pressure turbine section and a low pressure turbine section is accommodated in a single turbine casing.

There has been attempted to realize a steam turbine having a main steam pressure of 100 kg/cm$^2$ or more, a main steam temperature of 500° C. or more, and a rated output (power) of 100 MW or more, which are rotated at a rotation speed of 3,000 rpm in the case of being equipped with a last-stage movable blade of turbine having an effective blade length of 36 inches or more, or which are rotated at a rotation speed of 3,600 rpm in the case of being equipped with a last-stage movable blade of turbine having an effective blade length of 33.5 inches or more. In such steam turbine, a set of a high pressure turbine section, an intermediate pressure turbine section and a low pressure turbine section or a set of a high pressure turbine section and a low pressure turbine section is provided on a single turbine rotor (turbine shaft) supported by two journal bearings placed on a pedestal, each of these turbine sections being integrally accommodated in a single turbine casing. However, such steam turbine has not yet been bought into practice at present and remain on the drawing board because of their technical difficulty, particularly, difficulty of preventing shaft vibrations caused by insufficient stiffness of the shafting in association with the increased bearing span.

A steam turbine satisfying the above-mentioned design requirements may have a configuration as shown in FIG. 17, for example.

In this steam turbine, a turbine casing 1 has a double casing structure consisting of an outer casing 1*a* and an inner casing 1*b*, and in the inner casing 1*b* of the double casing structure, for example, a high/intermediate pressure integrated turbine rotor 4 having a high pressure turbine section 2 and an intermediate pressure turbine section 3 is accommodated. On the other hand, a low pressure turbine casing 5 also has a double casing structure consisting of an outer casing 5*a* and an inner casing 5*b*, and a low pressure turbine rotor 7 having low pressure turbine sections 6*a*, 6*b*, in which steams flow in directions opposing to each other, is accommodated in the inner casing 5*b* of the double casing structure. The low pressure turbine rotor 7 and the high/intermediate pressure integrated turbine rotor 4 are connected with each other through a coupling 8.

In another steam turbine, for example, as shown in FIG. 18, a high/intermediate pressure integrated turbine rotor 4 is accommodated in the inner casing 5*b* of the double casing structure such as describe above, while a low pressure turbine rotor 7 having a low pressure turbine section 6, in which a steam flows as a single flow, is accommodated in an inner casing 5*b* of a low pressure turbine casing 5.

The low pressure turbine casings 5 shown in FIGS. 17 and 18 both are formed with a conical recess portion 11 at the position where the low pressure turbine rotor 7 is inserted in a turbine exhaust hood 10 (chamber or section) defined by a partition wall 9 to ensure an installation area for a journal bearing 12, and the turbine exhaust hood 10 is connected to a condenser (not shown) on its downstream side.

Furthermore, in the steam turbines shown in FIGS. 17 and 18, the high/intermediate pressure integrated turbine rotor 4 and the low pressure turbine rotor 7 are supported by three or four journal bearings 12.

On the other hand, even in the case of a steam turbine which employs, for example, the high/intermediate pressure integrated type turbine which does not satisfy the above-mentioned design requirements, for example, as shown in FIG. 19, a high/intermediate/low pressure integrated turbine rotor 4*a* having a high pressure turbine section 2, an intermediate pressure turbine section 3 and a low pressure turbine section 6 is supported by journal bearings 12 placed on pedestals 13*a*, 13*b*. The turbine exhaust hood 10 defined by a partition wall 9 is formed with a conical recess portion 11 and connected to a condenser, not shown, on its downstream side. In this case, since a bearing span S of the journal bearings 12 supporting the high/intermediate/low pressure integrated turbine rotor 4*a* is relatively short, it is possible to satisfactorily handle the problem of vibrations that occur during the operation.

Generally, in a steam turbine, as the output power increased because of increase in the pressure and temperature of the steam to be supplied, the number of turbine stages consisting of combination of turbine nozzles and turbine movable blades is increased to thereby respond to the increased power, so that the bearing span S of the turbine rotor is inclined to become long. For this reason, in the case of the high/intermediate/low pressure integrated turbine 4*a* having e.g., the high pressure turbine section 2, the intermediate pressure turbine section 3 and the low pressure turbine section 6 on a single shaft, the bearing span S becomes long. Accordingly, providing that a shaft diameter of the high/intermediate/low pressure integrated turbine 4*a* is defined as $D_O$, as the ratio of the shaft diameter with respect to the bearing span S ($S/D_O$) becomes higher, the stiffness of the shaft becomes lower, and according to the lowering of the eigenvalue (characteristic value) frequency of the shaft, the critical speed becomes lower, thus, making it difficult to satisfactorily operate the steam turbine.

Particularly, for bringing such a steam turbine into practice that has a main steam pressure of 100 kg/cm$^2$ or more, a main steam temperature of 500° C. or more, and a rated output of 100 MW or more, rotated at a rotation speed of 3,000 rpm in the case of being equipped with a last-stage movable blade of turbine having an effective blade length of 36 inches or more or rotated at a rotation speed of 3,600 rpm in the case of being equipped with a last-stage movable blade of turbine having an effective blade length of 33.5 inches or more, and that employs a single turbine rotor supported by two journal bearings placed on pedestals, if the conventional technique is directly applied, the bearing span S becomes long to lower the critical speed, and in particular, as the secondary critical speed approaches the rated rotation speed, vibrations of the shaft is increased, which can hinder the operation.

SUMMARY OF THE INVENTION

The present invention was conceived in view of the the problems or defects encountered in the prior art mentioned above and an object of the invention is to provide a steam turbine capable of producing larger amount of work per one turbine stage, as well as allowing stable operation by shortening the bearing span.

This and other objects can be achieved according to the present invention by providing, in one aspect, a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, where in a turbine exhaust chamber of the low pressure turbine section has a structure extending towards both sides of a transverse direction of the turbine casing.

In another aspect, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein a turbine exhaust chamber of the low pressure turbine section has a structure extending towards the upper side of the turbine casing.

In a further aspect of the present invention, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, where in a turbine exhaust chamber of the low pressure turbine section has a structure extending in the axial direction thereof.

In this aspect, the turbine exhaust chamber is provided with a spreading path defined by an outer peripheral wall and an inner peripheral wall thereof and the inner peripheral wall is formed with a conical recess portion for installing a journal bearing.

In a still further aspect, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein when a throat area of a turbine nozzle is defined as $A_N$, and a throat area of a turbine movable blade is defined as $A_B$ in the high pressure turbine section, a ratio of the two throat areas ($A_B/A_N$) is set within a range of:

$$1.6 \leqq A_B/A_N \leqq 1.8.$$

In a still further aspect, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein an inner radius of a turbine movable blade in a turbine stage of the high pressure turbine section is gradually increased along a flow direction of a steam and when the inner radius of the turbine movable blade is defined as Rr, and an inner radius of a turbine movable blade in the next stage of the high pressure turbine is defined as Rrn, a ratio of the two radiuses (Rrn/Rn) is set within a range of:

$$1 < Rrn/Rr \leqq 1.05.$$

In a still further aspect of the present invention, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein an inner radius of a turbine movable blade in a turbine stage of the intermediate pressure turbine section is gradually increased along a flow direction of a steam, and when the inner radius of the turbine moving blade is defined as Rr, and inner radius of a turbine movable blade in the next stage of the intermediate pressure turbine is defined as Rrn, a ratio of the two radiuses (Rrn/Rn) is set within a range of:

$$1 < Rrn/Rr \leqq 1.1.$$

In a still further aspect of the present invention, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein the number of turbine stages of the high pressure turbine section is set to 7–10, the number of turbine stages of the intermediate pressure turbine section is set to 4–7 and the number of turbine stages of the low pressure turbine section is set to 5–7.

In a still further aspect, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein a throat/pitch ratio ($S_N/t_N$) at an average radius of a turbine nozzle of the high pressure turbine section is set within a range of:

$$S_N/t_N=0.15 \text{ to } 0.21,$$

while a throat/pitch ratio ($S_B/t_B$) at an average radius of the turbine movable blade of the high pressure turbine section is set within a range of:

$$S_B/t_B=0.27 \text{ to } 0.33.$$

In a still further aspect of the present invention, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more; or a unit rotated at a rotation speed of 3,600 rpm equipped with a last-stage movable blade of the turbine having an effective blade length of 33.5 inches or more, wherein a flow direction of a steam flowing through turbine stages of the high pressure turbine section and the flow direction of the steam flowing through turbine stages of the intermediate pressure turbine section are opposed to each other, and when a diameter of a high/intermediate pressure intermediate gland part defining the high pressure turbine section and the intermediate pressure turbine section is defined as $\phi D_1$ and a diameter of a high pressure turbine second stage gland part of the high pressure turbine section is defined as $\phi D_2$, the diameter $\phi D_1$ of the high/intermediate pressure intermediate ground part is set within a range of:

$$\phi D_1=(0.95 \text{ to } 0.98)\times\phi D_2.$$

In a still further aspect of the present invention, there is provided a steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein when an inner diameter of a steam path in a high pressure second stage part of the high pressure turbine section is defined as $\phi D_{HP}$, and inner diameter of a steam path in an intermediate pressure first stage part of the intermediate pressure turbine section is defined as $\phi D_{1P}$, the ratio of the two inner diameters ($\phi D_{IP}/\phi D_{HP}$) is set within a range of:

$$1.2\leqq\phi D_{IP}/\phi D_{HP}\leqq1.5.$$

As described above, according to the steam turbine of the present invention satisfying the above-mentioned various design requirements, it is possible to improve the stiffness of the shafting arrangement of the steam turbine to thereby suppress vibrations of the shaft.

Moreover, according to the steam turbine of the present invention satisfying the above-mentioned design requirements, since there is selected either one of appropriate setting of the ratio of the threat area between the turbine nozzle and turbine movable blade, appropriate setting of the inner radius of the steam path, appropriate settings of the numbers of stages of the high pressure turbine section, the intermediate pressure turbine section and the low pressure turbine section, appropriate setting of the throat/pitch ratio of each of the turbine nozzle and the turbine movable blade and appropriate setting of the diameter of the turbine rotor, it becomes possible to operate the steam turbine while keeping high turbine stage efficiency in a stable and safety manner.

The nature and further characteristic features of the present invention will be made further clear from the following descriptions made with reference to the accompanying drawings.

DESCRIPTION OF THE PREFERRED EMBODIMENTS

Figure 1:
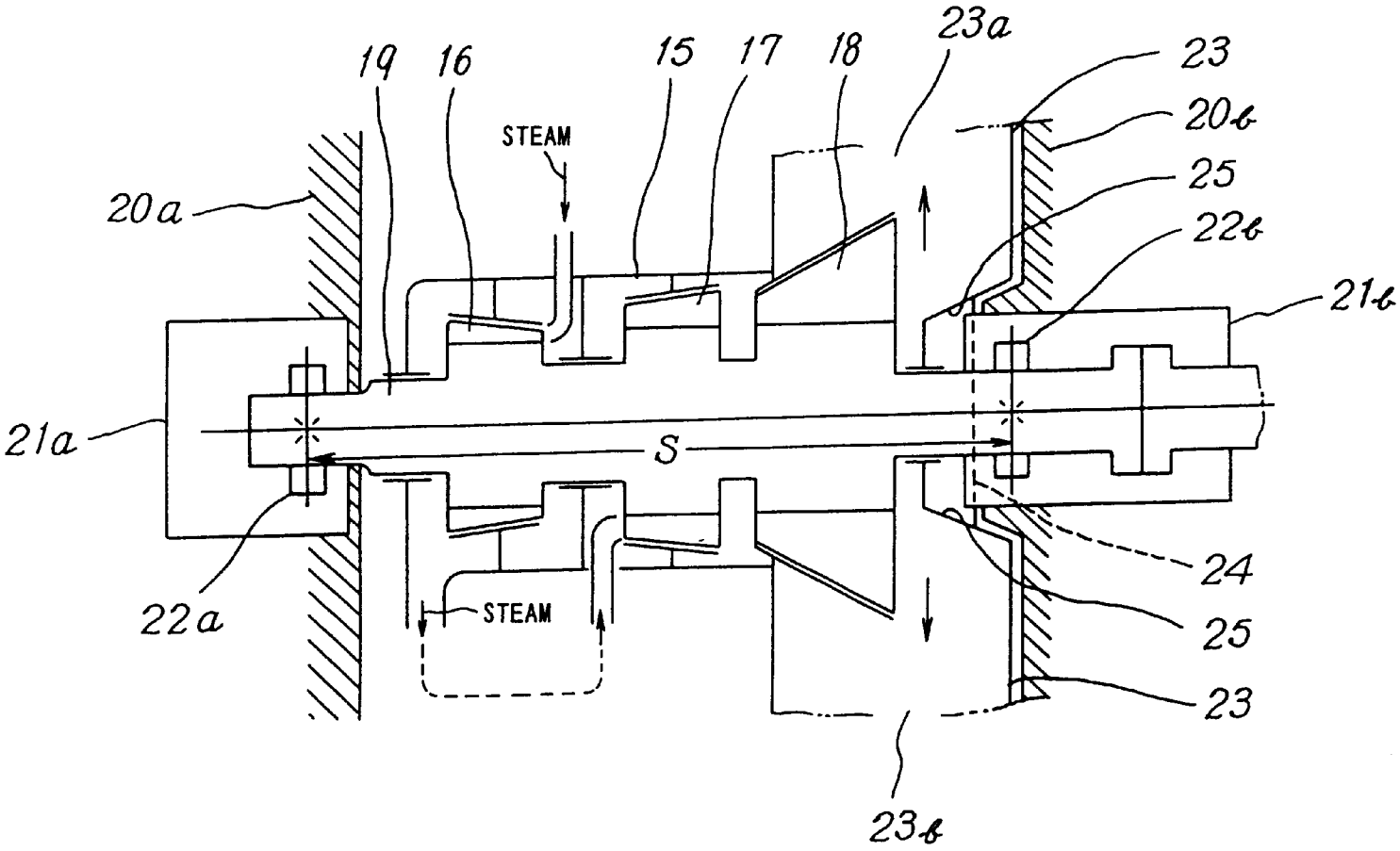
FIG. 1 is a schematic transverse sectional view showing a first embodiment of a steam turbine according to the present invention.

In the followings, embodiments of a steam turbine according to the present invention will be described with reference to the accompanying drawings and reference numerals denoted therein.

The steam turbine according to the present invention generally satisfies the design requirements of: a steam turbine having a main steam pressure of 100 kg/cm$^2$ or more; a main steam temperature of 500° C. or more; a rated output (power) of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more.

FIG. 1 is a schematic transverse sectional view showing a first embodiment of the steam turbine according to the present invention.

The steam turbine according to this first embodiment is adapted to a steam turbine of the high/intermediate/low pressure integrated type, for example, and is so configured that a high/intermediate/low pressure integrated turbine rotor 19 having a high pressure turbine section 16, an intermediate pressure turbine section 17 and a low pressure turbine section 18 is accommodated in a high/intermediate/low pressure integrated turbine casing 15. Meanwhile, the high/intermediate/low pressure integrated turbine rotor 19 has both ends, in which one end on the side of the high pressure turbine section 16 thereof is supported by a high pressure side journal bearing 22*a* accommodated in a high pressure bearing box 21*a* placed on a pedestal 20*a,* and the other end on the side of the low pressure turbine section 18 thereof is supported by a low pressure side journal bearing 22*b* accommodated in a low pressure bearing box 21*b* placed on a pedestal 20*b*.

Furthermore, in the steam turbine according to the present embodiment, a turbine exhaust hood 23 (chamber) of so-called the side exhaust type is provided with openings 23*a,* 23*b* on both sides in the transverse direction of the high/intermediate/low pressure integrated turbine casing 15, and a connecting wall 24 provided on the bottom side of a recess portion 25, which is formed into a conical shape on the side of the low pressure side journal bearing 22*b* of the turbine exhaust hood 23 for connecting a condenser (not shown), is arranged near (i.e. is advanced to) the side of the high pressure side journal bearing 22*a* to thereby reduce a bearing span S as compared with the conventional steam turbine.

As described above, in the present embodiment, since the turbine exhaust hood 23 is provided on both sides in the traverse direction of the high/intermediate/low pressure integrated turbine casing 15, and the connecting body wall 24 for connecting the turbine exhaust hood 23 and the condenser is advanced to the side of the high pressure side journal bearing 22*a* so as to reduce the bearing span S, it is possible to suppress vibrations of the shaft by increasing the stiffness of shafting and to enable the steam turbine to operate in a safe manner.

Figure 2:
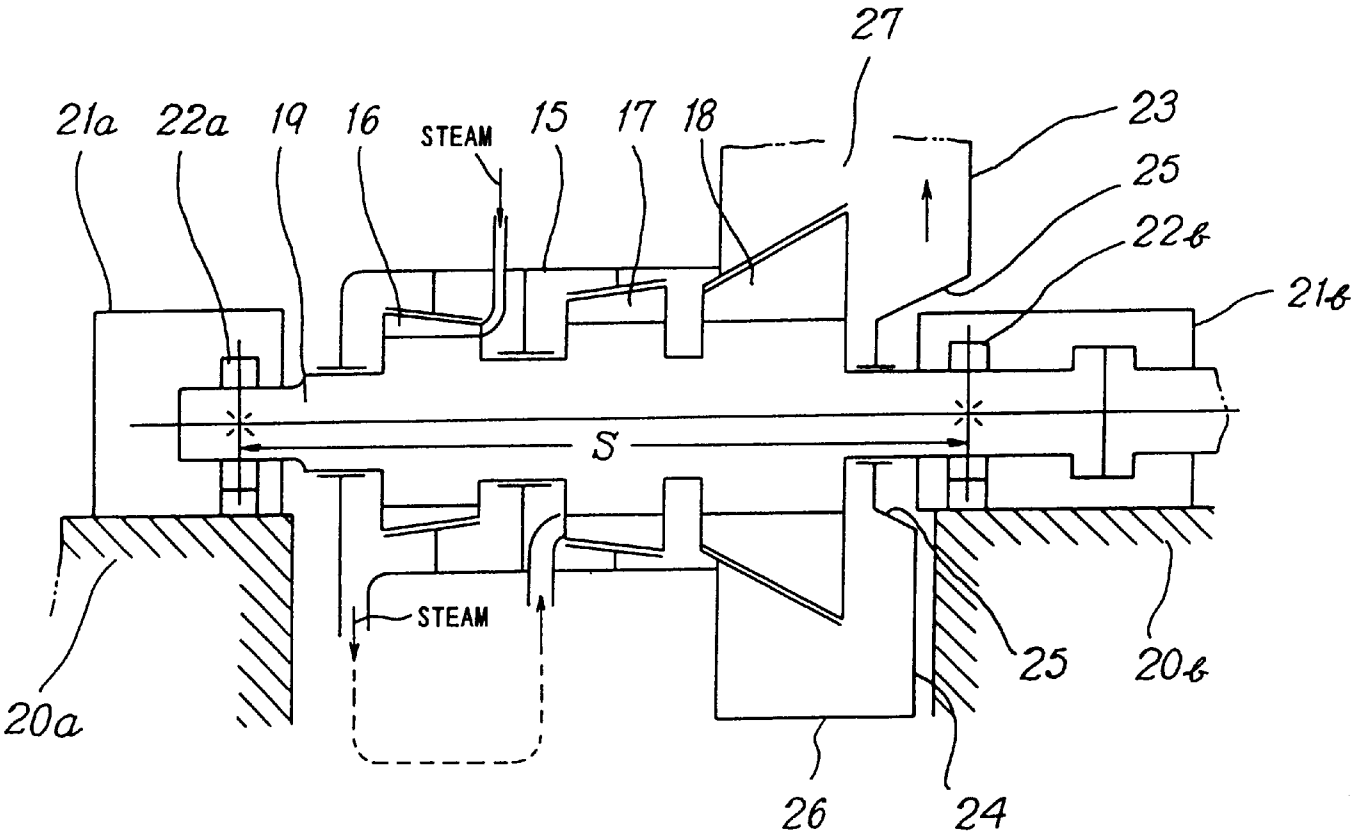
FIG. 2 is a schematic vertical sectional view showing a second embodiment of a steam turbine according to the present invention.
Figure 3:
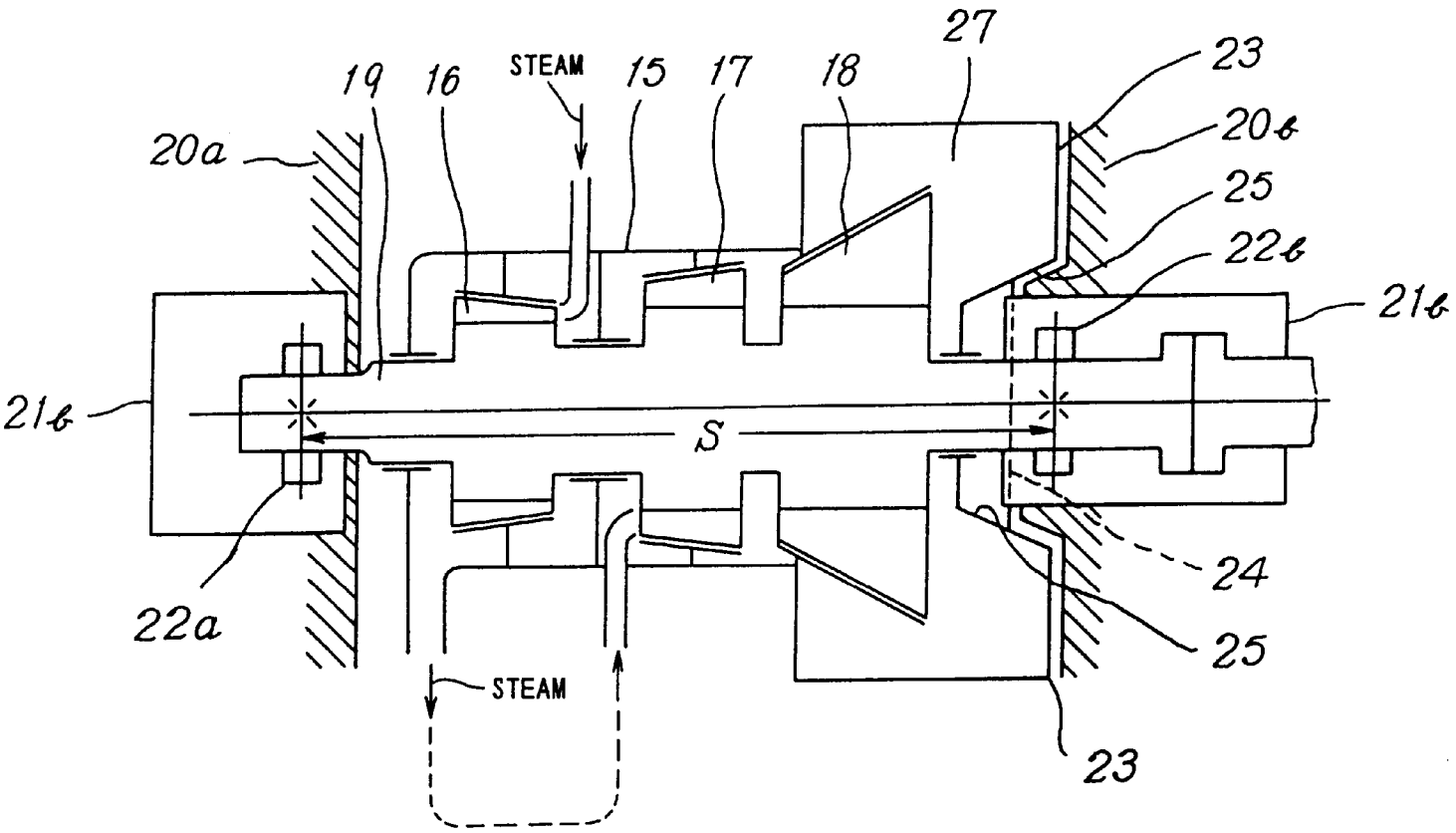
FIG. 3 is a schematic transverse sectional view showing the second embodiment of a steam turbine according to the present invention.

FIGS. 2 and 3 are schematic views showing a second embodiment of the steam turbine according to the present invention, in which elements or sections as same as those of the first embodiment are denoted by the same reference numerals.

In the steam turbine according to this second embodiment, as shown in FIG. 2, there is provided a turbine exhaust hood 23 of so-called the upper exhaust type which is choked by a choking plate 26 on the bottom side of a high/intermediate/low pressure integrated turbine casing 15 and formed with an opening 27 on the upper side of the same. As shown in FIG. 3, the connecting wall 24 provided on the bottom side of a recess portion 25, which is formed into a conical shape on the side of a low pressure journal bearing 22*b* of the turbine exhaust hood 23 for connecting a condenser, not shown, is advanced to the side of the high pressure side journal bearing 22*a* to thereby reduce the bearing span S as compared with the conventional steam turbine.

As described above, in the present embodiment, since the turbine exhaust hood 23 is choked by the choking plate 26 on the bottom side of the high/intermediate/low pressure turbine casing 15 and formed with the opening 27 on the upper side of the same and the connecting body wall 24 for connecting the turbine exhaust hood 23 with the condenser is advanced to the side of the high pressure side journal bearing 22*a* so as to reduce the bearing span S, it is possible to suppress vibrations of the shaft by increasing the stiffness of the shaft and to enable the steam turbine to operate in a safety manner.

Figure 4:
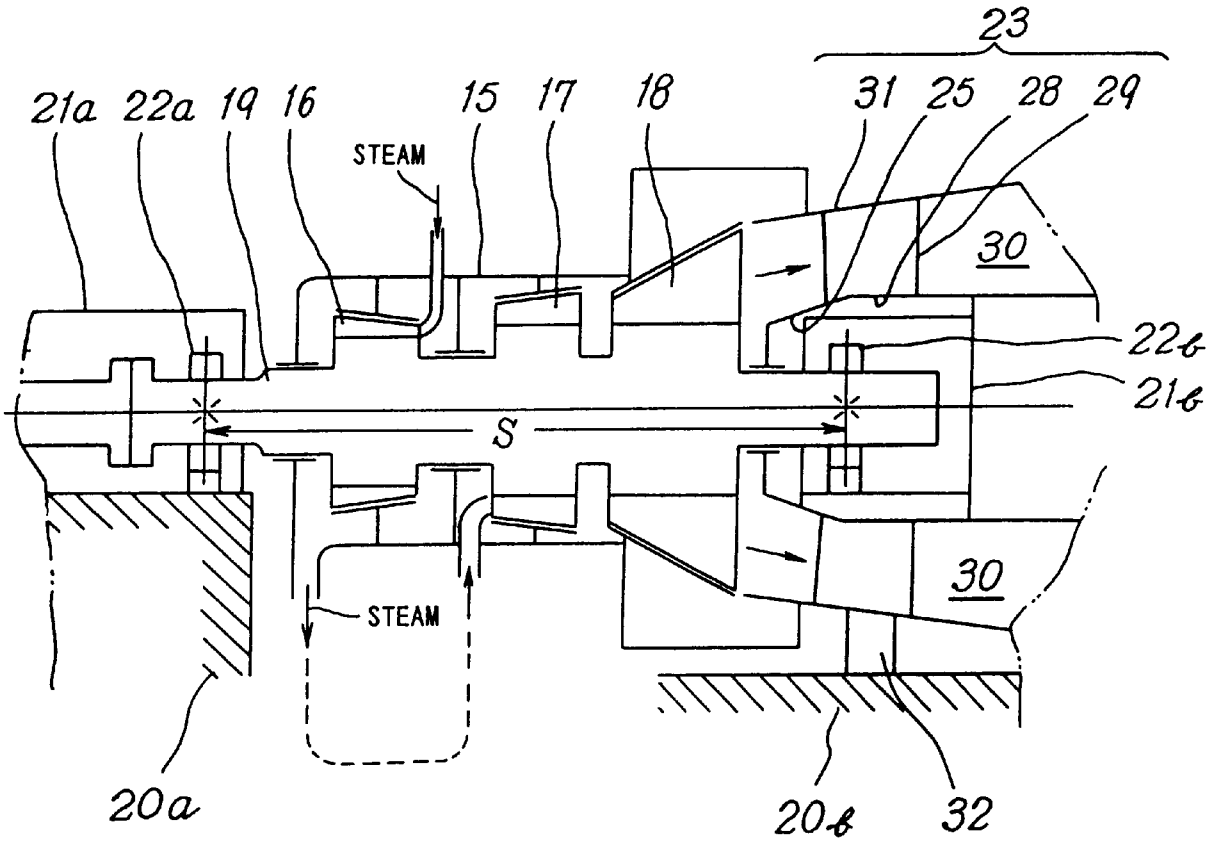
FIG. 4 is a schematic vertical sectional view showing a third embodiment of the steam turbine according to the present invention.

FIG. 4 is a schematic vertical sectional view showing a third embodiment of the steam turbine according to the present invention, in which elements or sections as same as those of the first embodiment are denoted by the same reference numerals.

The steam turbine according to this third embodiment has a turbine exhaust hood 23 formed into so-called an axial flow exhaust type.

This turbine exhaust hood 23 consists of an annular inner wall 28 which extends in the axial direction of a high/intermediate/low pressure integrated turbine rotor 19 from the exit side of a low pressure turbine 18 and formed in a conical recess portion 25, and an annular outer wall 31 which is formed outward the inner wall 28 through a strut 29 to define a spreading path 30 in cooperation with the inner wall 28. The outer wall 31 is supported by a pedestal 20*b* through a supporting member 32.

As described above, in this third embodiment, since the turbine exhaust hood 23 is formed into the axial flow exhaust type extended in the axial direction of the high/intermediate/low pressure integrated turbine rotor 19, and the pedestal 20*b* disposed in the inner wall 28 defining the conical recess portion 25 and supporting the low pressure side journal bearing 22*b* is advanced to the side of the high pressure side journal bearing 22*a* so as to reduce the bearing span S, it is possible to suppress vibrations of the shaft by increasing the stiffness thereof and to enable the steam turbine to operate in a safety manner.

Figure 5:
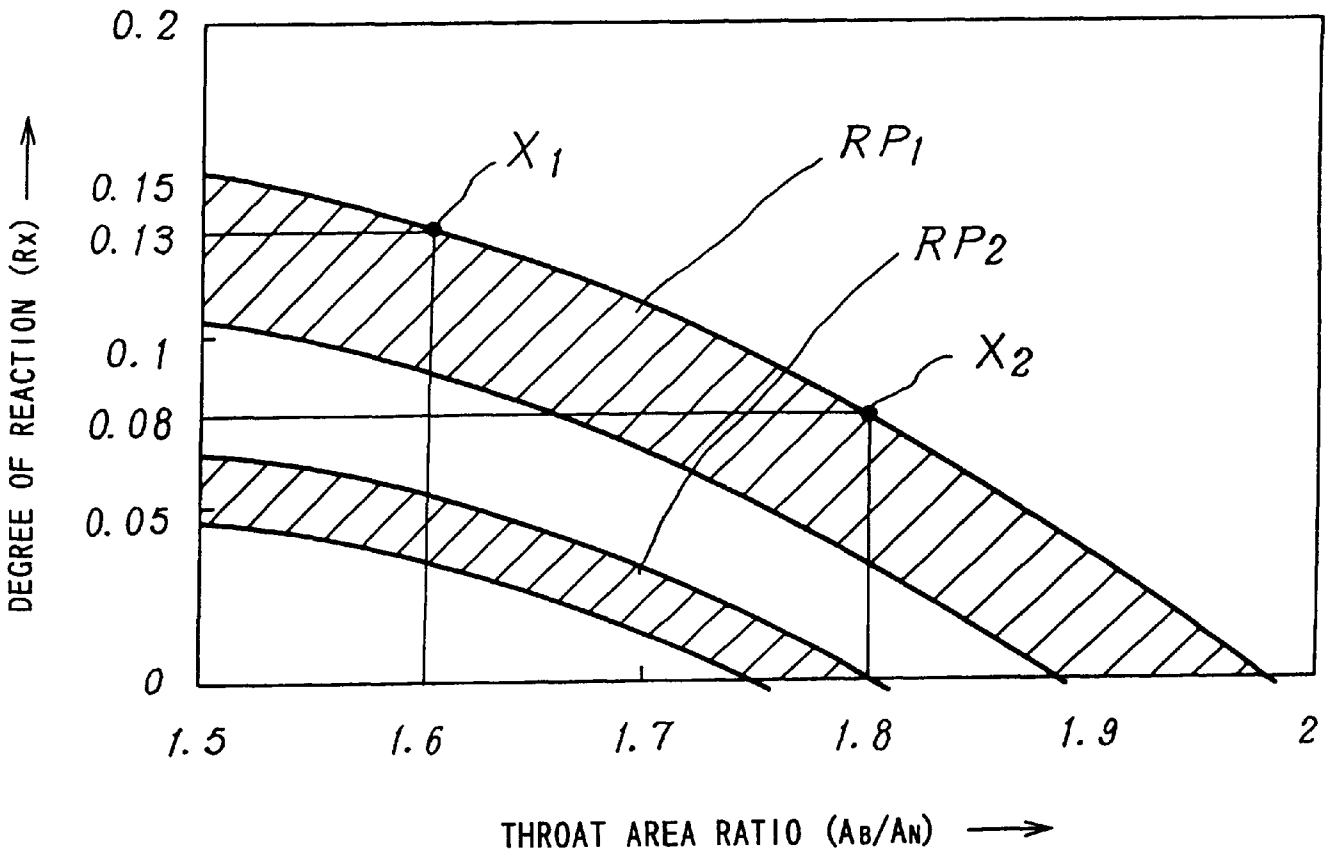
FIG. 5 is a distribution diagram of degree of reaction applied to a high pressure turbine section of the steam turbine according to the present invention.

FIG. 5 is a distribution diagram of degree of reaction indicating the relationship between the degree of reaction Rx and the throat area ratio $A_B/A_N$ of turbine stage in the high pressure turbine section of the steam turbine according to the present invention. In this context, the term "throat area ratio $A_B/A_N$" is the ratio of throat area when the throat area of a certain turbine movable blade is defined as $A_B$ and throat area of a certain turbine nozzle is defined as $A_N$ in a certain turbine stage composed of combination of a turbine nozzle and a turbine movable blade. Further, in FIG. 5, the degree of reaction distribution area $RP_1$ shaded by oblique lines shows the average radius of turbine stage (pitch circle radius) and the degree of reaction distribution area $RP_2$ shaded by oblique lines shows inner radius of turbine stage (blade root radius).

Now, when theoretical speed in proportion to the square root of the output (power) of turbine stage is defined as $C_O$, peripheral speed of rotation at turbine stage average radius Rm as U, degree of reaction at turbine stage average radius Rm as Rxm, and speed ratio as $U/C_O$, it is known that the speed ratio $(U/C_O)_{OPT}$ which maximizes the efficiency of the turbine stage is inversely proportional to the square root of (1−Rxm) (See "Steam Turbine (Theory and Basis)", published from SANPO-SHA, 1982).

As described above, since the speed ratio $(U/C_O)_{OPT}$ which maximize the efficiency of turbine stage is inversely proportional to the square of (1−Rxm), the smaller the degree of reaction Rxm at turbine stage average radius Rm is, the smaller the speed ratio $(U/C_O)_{OPT}$ becomes, which makes it possible to keep high the efficiency of turbine stage even when output per turbine stage becomes large.

The present embodiment takes advantage of the above point, and in order to reduce the bearing span with reduced number of turbine stages, in a steam turbine having a main steam pressure of 100 kg/cm$^2$ or more, a main steam temperature of 500° C. or more, and a rated output of 100 MW or more, which is rotated at a rotation speed of 3,000 rpm in the case of being equipped with a last-stage movable blade of a turbine having an effective blade length of 36 inches or more, or which is rotated at a rotation speed of 3,600 rpm in the case of being equipped with a last-stage movable blade of the turbine having an effective blade length of 33.5 inches or more, the degree of reaction Rx at the average radius of the turbine stage Rm corresponding to the speed ratio $(U/C_O)_{OPT}$ is set at 0.13 or less from FIG. 5, and the throat area ratio $A_B/A_N$ is set at 1.6 or more from the intersection $X_1$ between the degree of reaction Rx=0.13 and the degree of reaction distribution area $RP_1$.

Contrarily, if the degree of reaction Rx at the average radius of turbine stage Rm is reduced too much extent to cause the degree of reaction Rx at the inner radius of turbine stage to be minus values, the steam will flow reversely so that the efficiency of turbine stage is deteriorated. For this reason, the degree of reaction Rx is set at 0.08 from FIG. 5, and from the intersection $X_2$ between the degree of reaction Rx=0.08 and the degree of reaction distribution area $RP_1$, the throat area ratio $A_B/A_N$ is set at 1.8 or less, which will not cause the degree of reaction Rx to become minus values.

The most preferable applicable range for the throat area ratio $A_B/A_N$ is $$1.6 \leqq A_B/A_N \leqq 1.8$$

as far as those estimated in the model turbine.

As described above, in the third embodiment, since the throat area ratio $A_B/A_N$ is set in the range of $1.6 \leqq A_B/A_N \leqq 1.8$, and the output per turbine stage is increased to thereby reduce the bearing span, it is possible to suppress vibrations of the shaft by increasing the stiffness of the shaft and to enable the steam turbine to operate in a safety manner.

Figure 6:
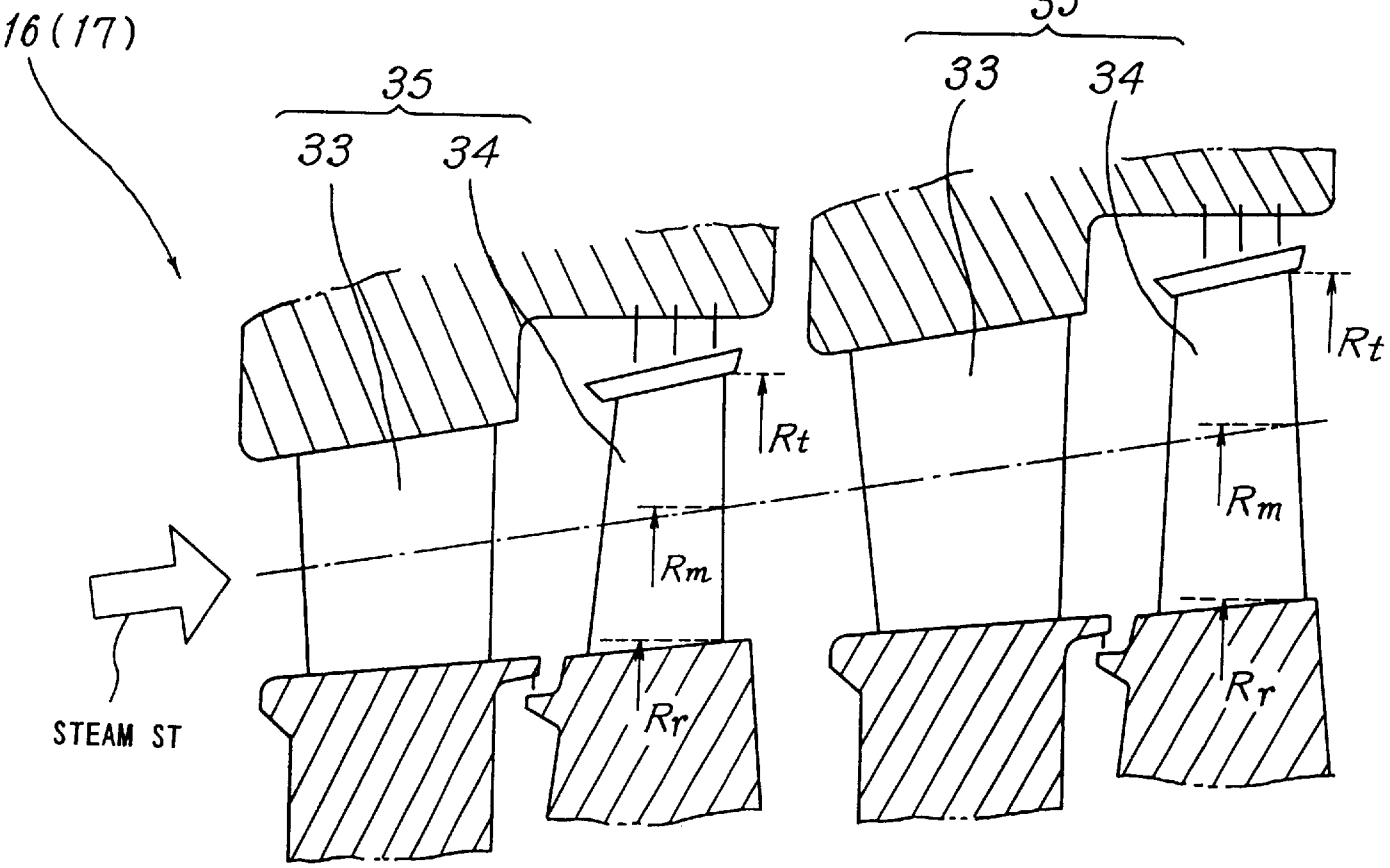
FIG. 6 is a general schematic view showing a fourth embodiment of a steam turbine according to the present invention.

FIG. 6 is a schematic view showing a fourth embodiment of the steam turbine according to the present invention, in which elements or sections as same as those of the first embodiment are denoted by the same reference numerals.

The steam turbine according to this fourth embodiment is applied for the high pressure turbine section 16 and the intermediate pressure turbine section 17. In this embodiment, a turbine stage 35 consisting of a turbine nozzle 33 and a turbine movable blade 34 is disposed in plural along the flow of the steam ST. In a case where the radius from the center of the turbine shaft, not shown, to the tip of the turbine movable blade 34 is defined as Rt, the radius to the root of the turbine movable blade 34 is defined as Rr, and the average radius (pitch circle radius) of the tip and the root of the turbine movable blade 34 is defined as Rm, the respective radiuses Rt, Rr and Rm are gradually increased along the flow of the steam ST. In this context, each of the radiuses Rt, Rr and Rm is set with reference to an output end of the turbine movable blade 34.

Incidentally, recent steam turbines include ones of the impulse/reaction combination type in which degree of reaction Rx is adopted to the turbine movable blade 34 in addition to the turbine nozzle 33, even though the whole of the turbine stages 35 are impulse stages. This type of steam turbine causes the turbine nozzle 33 to expand and accelerate the steam ST and causes the turbine movable blade 34 to convert the velocity energy generated at that time to a rotational energy, while causing the turbine movable blade 34 to expand and accelerate the steam ST, and the velocity energy generated at that time is also added to the rotational energy.

Figure 20:
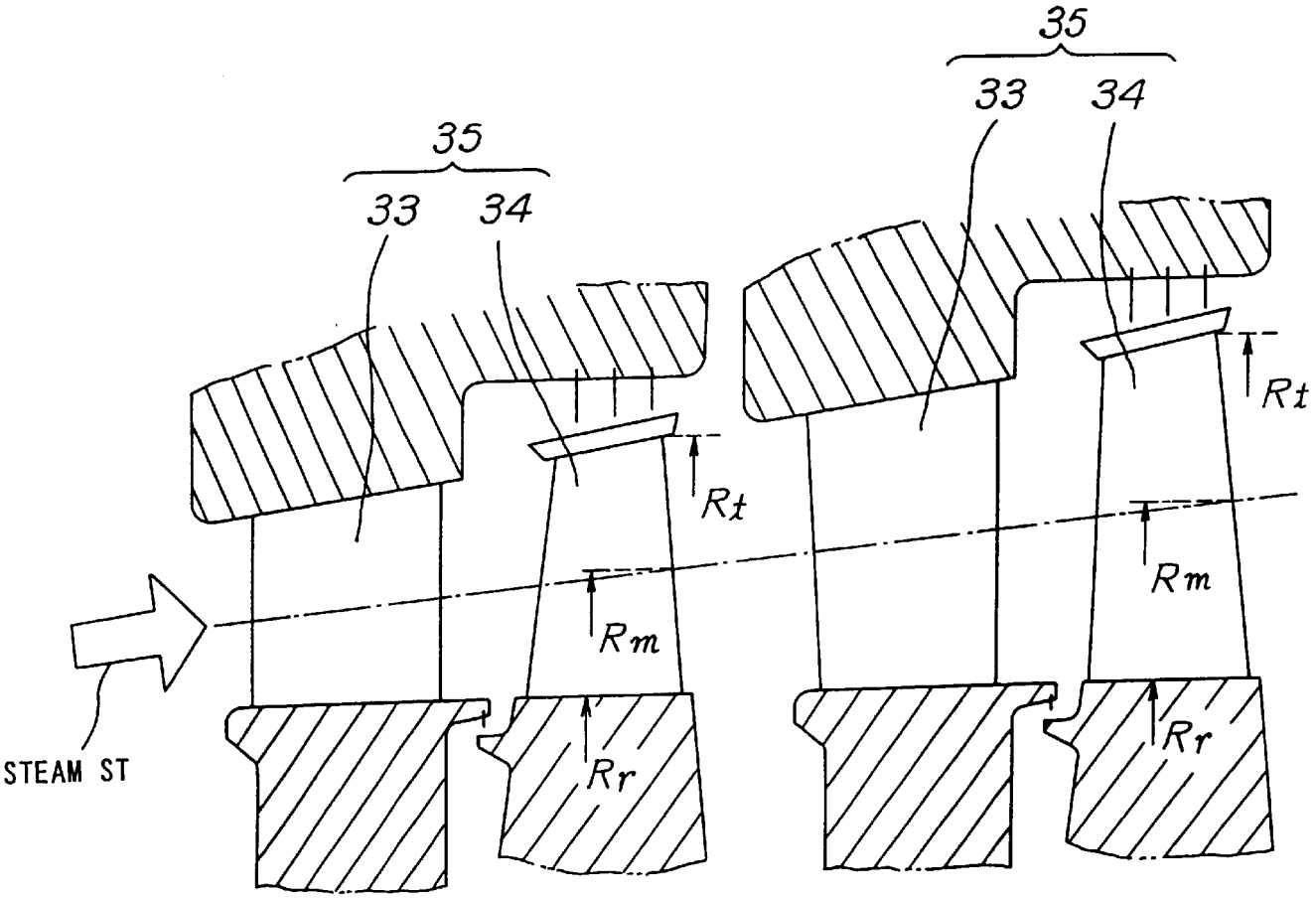
FIG. 20 PRIOR ART
FIG. 20 is a general schematic view showing a conventional steam turbine in which inner radiuses of turbine stages are equal to each other.

In such an impulse/reaction combination type steam turbine, in designing the turbine stages 35, as shown in FIG. 20, in a prior art, the inner radius Rr of the turbine movable blade 34 was made constant along the flow direction of the steam ST, while the average radius Rm and the outer radius Rt of the turbine movable blade 34 were gradually increased along the flow direction of the steam ST. At this time, degree of reaction Rxr at the inner radius Rr of the turbine movable blade 34 was set in the range between 0% to 5%, and the actual speed ratio $(U/C_O)$ giving an arbitrary efficiency of the turbine stage 35 and the optimal speed ratio $(U/C_O)_{OPT}$ giving the maximum efficiency of the turbine stage 35 were both set at about 0.5.

Figure 21:
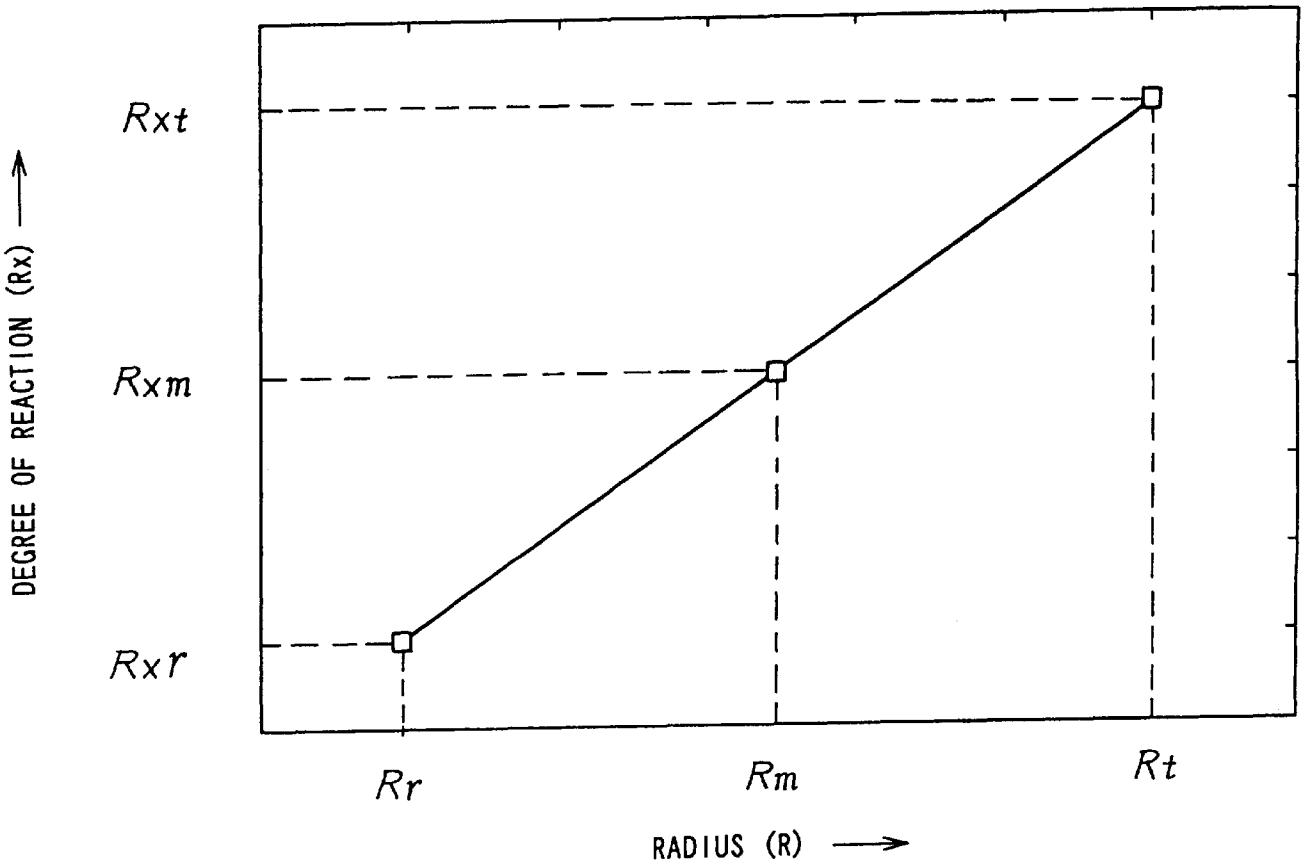
FIG. 21 PRIOR ART
FIG. 21 is a distribution diagram of degree of reaction showing the degree of reaction of the conventional steam turbine.

Moreover, in a case where the respective degrees of reaction at the radiuses Rr, Rm and Rt of the high pressure turbine 16 having a relatively short blade length are defined as Rxr, Rxm and Rxt, the degree of reaction was linearly increased from the inner radius Rr to the outer radius Rt, in a prior art, as shown in FIG. 21.

Figure 19:
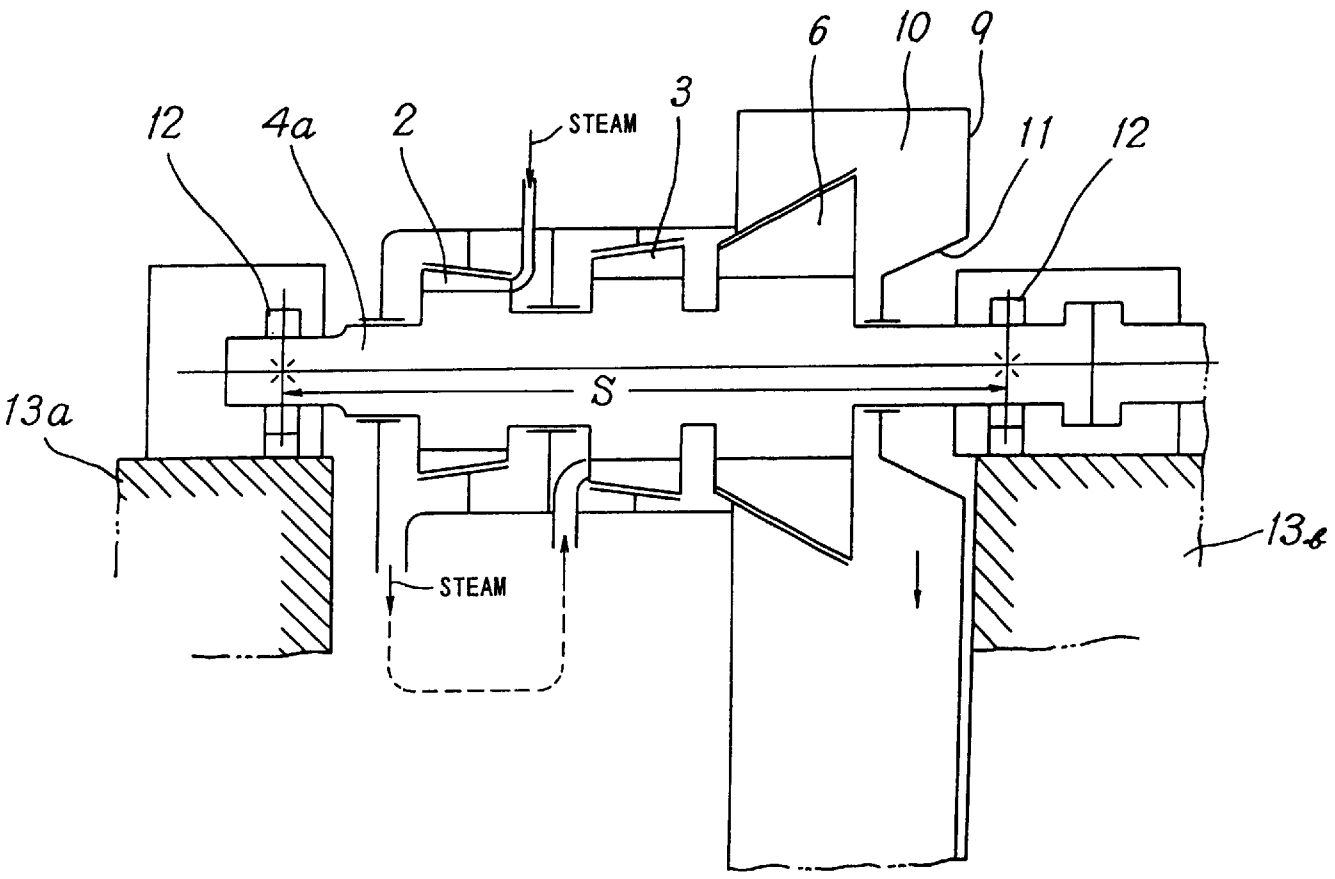
FIG. 19 PRIOR ART
FIG. 19 is schematic assembled vertical sectional view showing a conventional steam turbine of the high/intermediate/low pressure integrated structure.

However, in the case of the steam turbine according to the present embodiment which satisfies the design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, and which is applied for the high pressure turbine section 16 and the intermediate pressure turbine section 17, if the inner radius Rr of the turbine movable blade 34 shown in FIG. 19 is made constant along the flow direction of the steam ST, the output (power) per turbine stage is increased, so that the speed ratio $(U/C_O)$ drops at stages on the downstream of the steam flow to about 0.45, but, on the contrary, the optimal speed ratio $(U/C_O)_{OPT}$ rises to about 0.55 as a result of increase in degree of reaction Rxm at the average radius Rm, which causes a disadvantage or problem that the efficiency of the turbine stage 35 is lowered.

Figure 7:
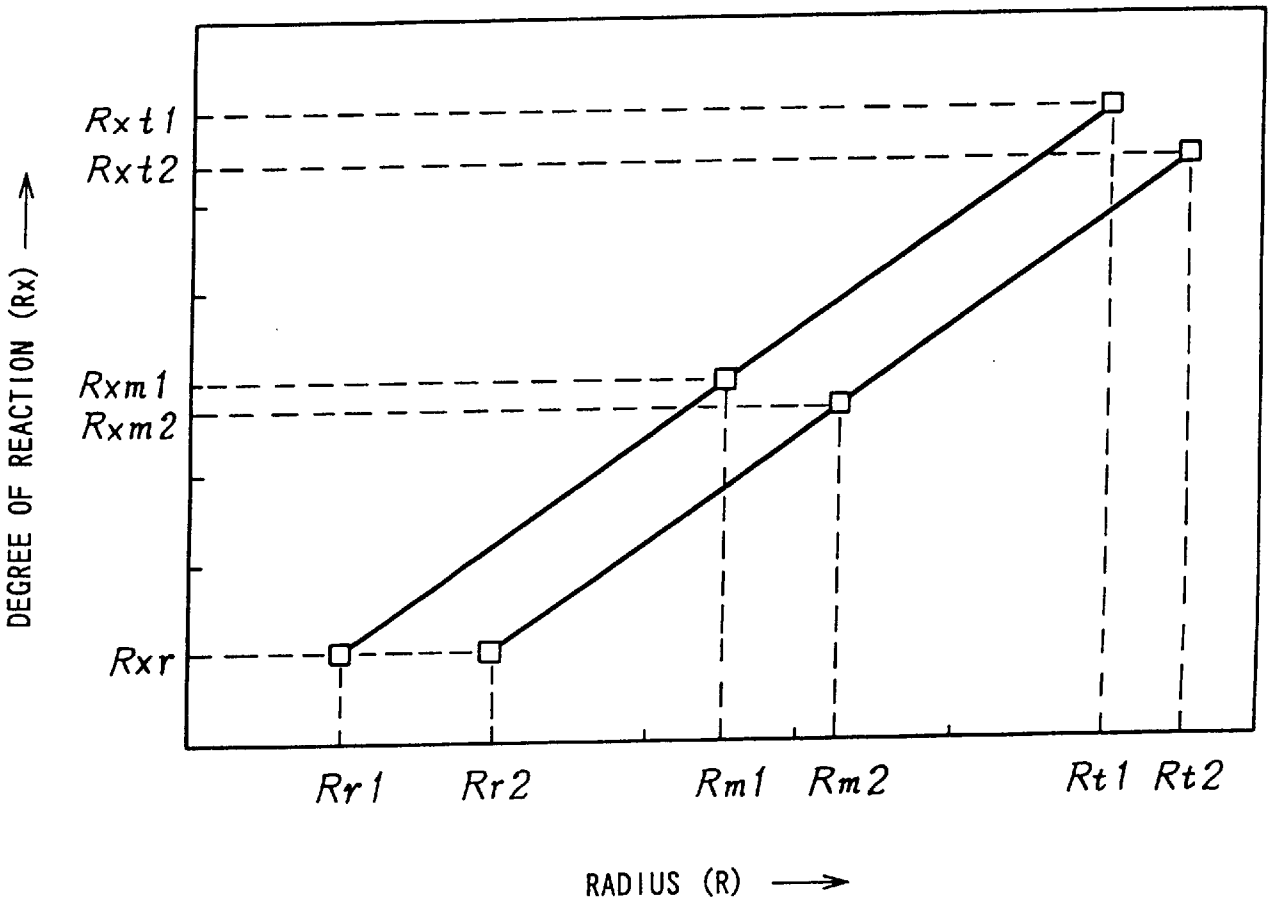
FIG. 7 is a distribution diagram of degree of reaction in which degree of reaction of the steam turbine according to the present invention is compared with that of the conventional steam turbine.

This fourth embodiment was made in consideration of the above-mentioned points, and by gradually increasing the inner radius Rr of the turbine movable blade 34 along the direction of the steam flow ST as shown in FIG. 6, the average radius Rm2 of the turbine movable blade 34 becomes larger than the average radius Rm1 of the conventional steam turbine because of increase in the inner radius Rr of the turbine movable blade 34 as shown in FIG. 7. For this reason, in addition to the increasing of the rotational peripheral speed U, the degree of reaction Rxm2 at the average radius Rm of the turbine movable blade 34 also becomes smaller than the degree of reaction Rxm1 of the conventional one because of decrease in the blade length, and accordingly, it is possible to keep high the efficiency of the turbine stage 35 by substantially coinciding the actual speed ratio $(U/C_O)$ with the optimal speed ratio $(U/C_O)_{OPT}$, so that a steam turbine satisfying the above-mentioned design requirements can be realized. In this concept, FIG. 7 shows a comparison between a degree of reaction distribution line Rx2 according to the present embodiment when the inner radius Rr of the turbine movable blade 34 is gradually increased along the direction of the steam flow ST and the degree of reaction distribution line Rx1 according to the conventional steam turbine when the inner radius Rr of the turbine movable blade 34 is made constant along the direction of the steam flow ST, in which the subscripts 2 and 1 represent the fourth embodiment of the invention and the conventional steam turbine, respectively.

On the other hand, if the inner radius Rr of the turbine movable blade 34 is set too large along the direction of the steam flow ST, then the actual speed ratio $(U/C_O)$ becomes larger than the optimal speed ratio $(U/C_O)_{OPT}$, so that the efficiency of the turbine stage 35 is rather reduced.

Figure 8:
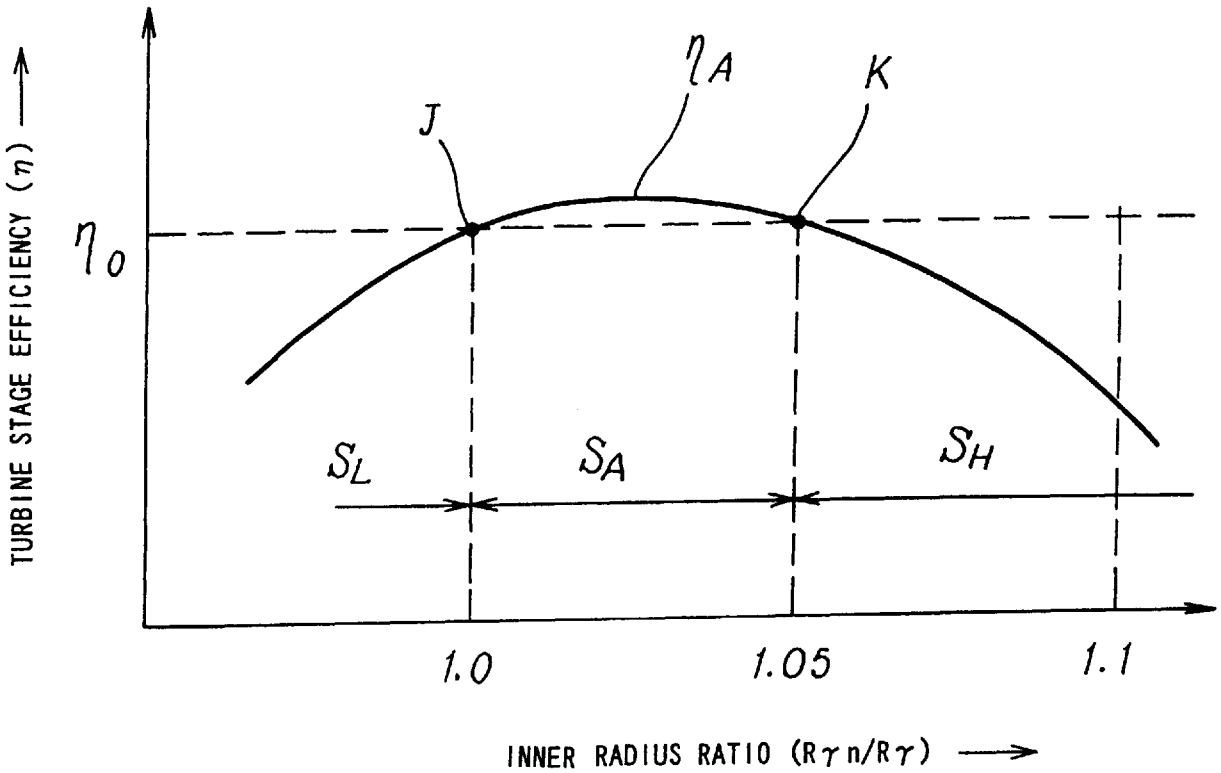
FIG. 8 is a distribution diagram of turbine stage efficiency showing a relationship between turbine stage efficiency and ratio of inner radius, which is applied to the high pressure turbine section of the steam turbine according to the present invention.

The present embodiment was made in consideration of the above-mentioned points, and in the high pressure turbine section 16, when the inner radius Rr of a particular (a stage now to be handled) turbine movable blade 34 is defined as Rr, the inner radius Rrn of the next-stage turbine movable blade 34 is defined as Rrn, and the turbine stage efficiency is defined asη, as shown in FIG. 8, the ratio of inner peripheral radius Rrn/Rr of the turbine moving blade 34 is set in the range of $$1<Rrn/Rr\leqq 1.05$$

within the area $S_A$ defined by intersections J, K between the set stage efficiency $\eta_O$ indicated by the broken line and the turbine stage efficiency distribution line $\eta_A$. This range was assured by a model turbine. Incidentally, in FIG. 8, the area $S_A$ is an area in which the actual speed ratio $(U/C_O)$ and the optimal speed ratio $(U/C_O)_{OPT}$ substantially coincide with each other, the area $S_H$ is an area in which the actual speed ratio $(U/C_O)$ is larger than the optimal speed ratio $(U/C_O)_{OPT}$, and the area SL is an area in which the actual speed ratio $(U/C_O)$ is smaller than the optimal speed ratio $(U/C_O)_{OPT}$.

As described above, in the present embodiment, since the ratio of inner radius Rrn/Rr between the particular turbine stage and the next turbine stage of the turbine movable blade 34 at the high pressure turbine section 16 is set within the range of $1<Rrn/Rr\leqq 1.05$ where the actual speed ratio $(U/C_O)$ substantially corresponds with the optimal speed ratio $(U/C_O)_{OPT}$, it is possible to keep high the efficiency of the turbine stage 35.

Additionally, in the present embodiment, since the volume flow rate of the steam ST in the intermediate pressure turbine section 17 is larger than that of the high pressure turbine section 16, it is necessary to study and reconsider the ratio of inner radius Rrn/Rr of the turbine movable blade 34 in the intermediate pressure turbine section 17.

Figure 9:
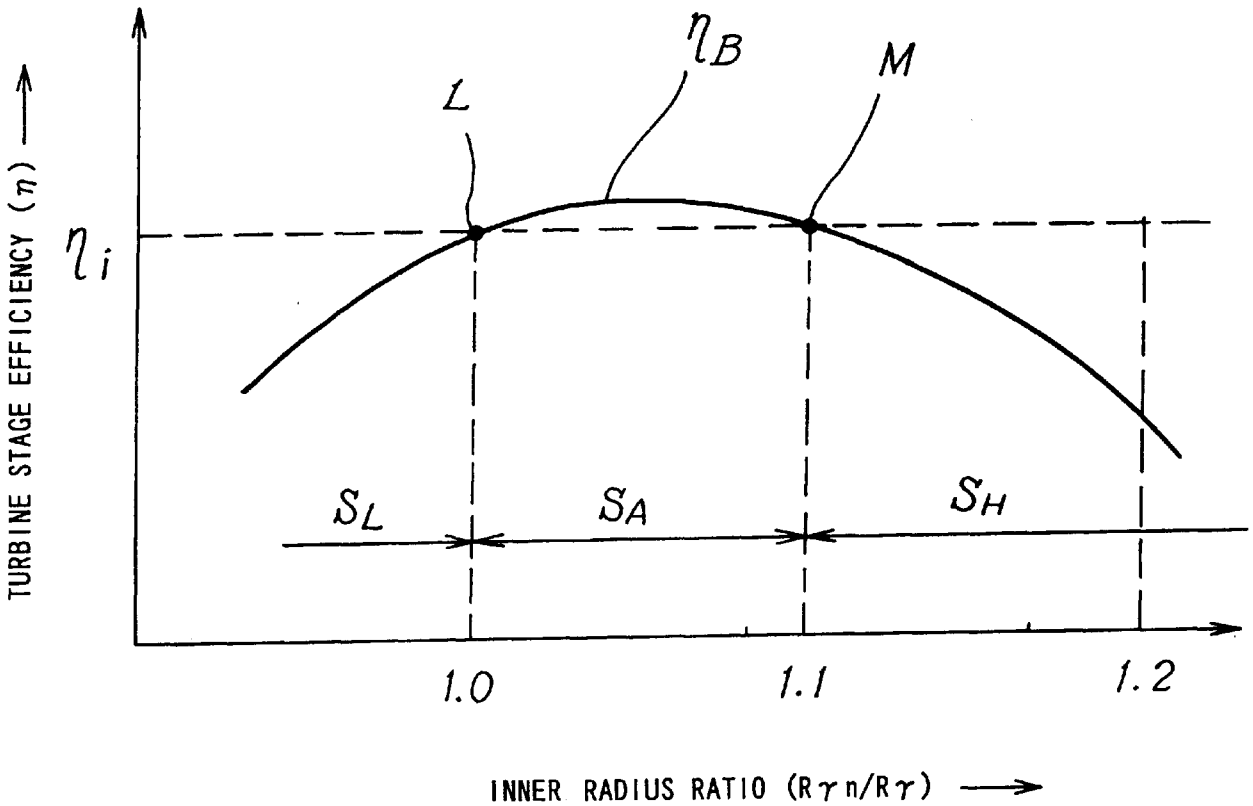
FIG. 9 is a distribution diagram of turbine stage efficiency showing a relationship between turbine stage efficiency and ratio of inner radius, which is applied to an intermediate pressure turbine section of the steam turbine according to the present invention.

In the present embodiment, as shown in FIG. 9, the ratio of inner radius Rrn/Rr of the turbine movable blade 34 in the intermediate pressure section 17 is set within the range of $$1<Rrn/Rr\leqq 1.1$$

within the area $S_A$ defined by intersections L, M between set stage efficiency $\eta_i$ indicated by the broken line and turbine stage efficiency distribution line $\eta_B$. This range was also assured by a model turbine. As described above, in the present embodiment, since the ratio of the inner radius Rrn/Rr between the particular turbine stage and the next turbine stage of the turbine movable blade 34 in the intermediate pressure turbine section 17 is set in the range of $1<Rrn/Rr\leqq 1.1$ where the actual speed ratio $(U/C_O)$ substantially coincides with the optimal speed ratio $(U/C_O)_{OPT}$, it is possible to keep high the efficiency of the turbine stage 35.

Figure 10:
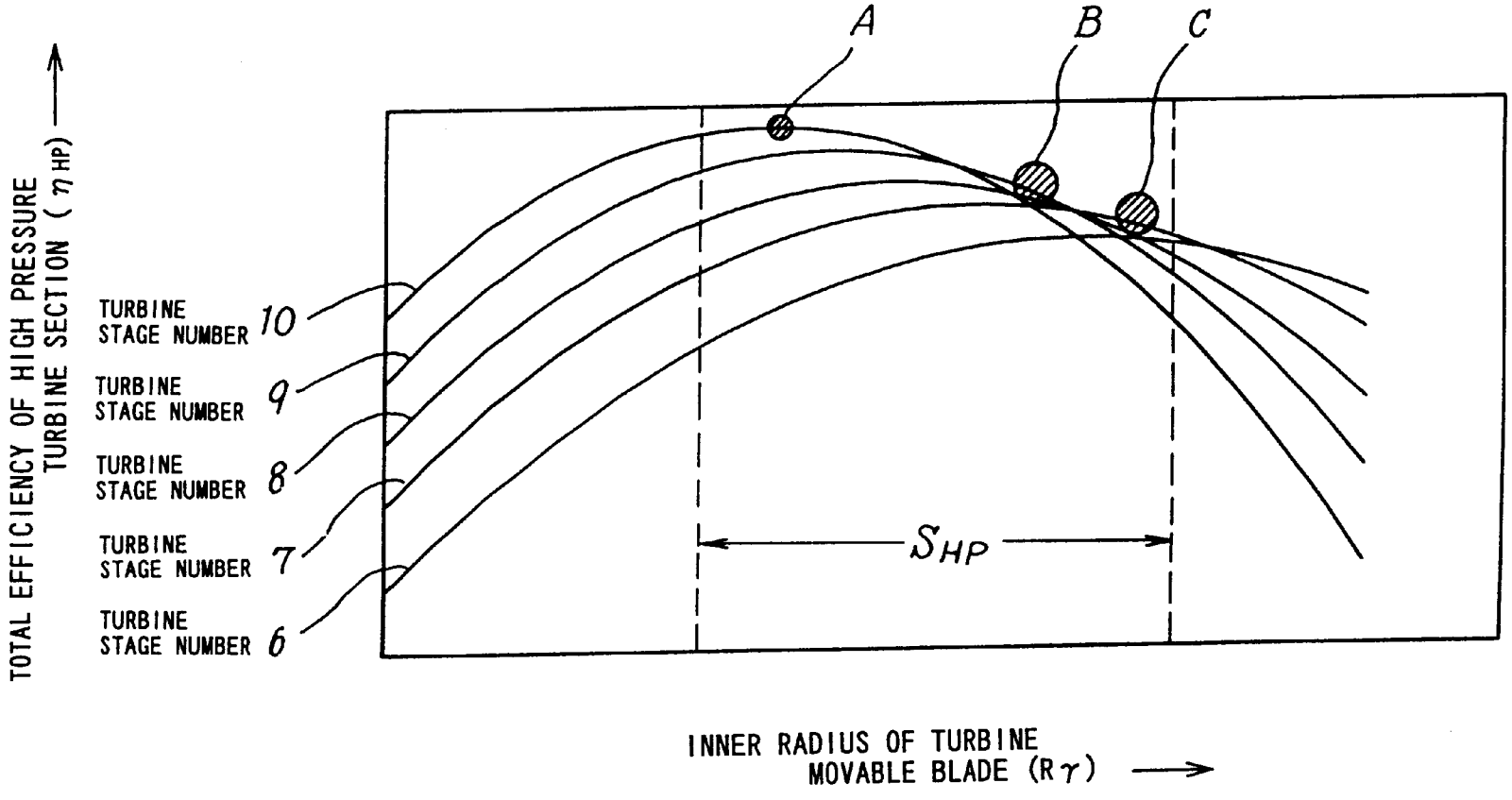
FIG. 10 is a turbine stage number selecting diagram indicating a turbine stage number from a relationship between the total efficiency of the high pressure turbine section and the inner radius of the turbine movable blade, which is applied to the high pressure turbine section of the steam turbine according to the present invention.

FIG. 10 is a turbine stage number selecting diagram for selecting the optimal number of the turbine stages in the high pressure turbine section according to the present invention, from the relationship between an entire efficiency of the high pressure turbine section $\eta_{HP}$ and the inner radius Rr of the turbine movable blade 34.

Since the turbine stage efficiency is a function of the speed ratio (U/C), the smaller the number of turbine stages, the larger the output per turbine stage becomes. Accordingly, the inner radius Rr of the turbine movable blade 34 which maximizes the total efficiency of high pressure turbine $\eta_{HP}$ also becomes large.

Furthermore, if consideration is taken from the view point of the strength of the turbine rotor (turbine shaft), the inner radius Rr of the turbine movable blade 34 to be applied to the high pressure turbine section 16 is necessarily limited because when the inner radius Rr of the turbine movable blade 34 is too small, it becomes difficult to form a fastening portion of the turbine movable blade 34. On the other hand, when the inner radius Rr of the turbine movable blade 34 is too large, stresses of the turbine movable blade 34 and its fastening portion will exceed the acceptable values. Consequently, the range of inner radius Rr of the turbine movable blade 34 which can be applied in the high pressure turbine section 16 is, as shown in FIG. 10, within the area $S_{HP}$.

At this time, in the case where a large number of turbine stages can be employed, the number of turbine stages is selected from the point A where the total efficiency of high pressure turbine section $\eta_{HP}$ is the largest at smaller inner radius Rr of the turbine movable blade, that is 10 (ten) stages is selected.

On the other hand, in the case where it is impossible to employ such a large number of turbine stages, the number of turbine stages is selected from the point B where the inner radius Rr of the turbine movable blade 34 is increased and the total efficiency of high pressure turbine section $\eta_{HP}$ becomes high, that is, 8–9 (eight to nine) stages is selected. Furthermore, when the inner peripheral radius Rr of the turbine movable blade 34 is brought nearer to the upper limit of the area $S_{HP}$, the number of the turbine stages is selected by the point C where the total efficiency of the high pressure turbine section $\eta_{HP}$ becomes the maximum, that is, 7 stages is selected.

As described above, in the present embodiment, since the number of turbine stages of the high pressure turbine section 16 is selected at 7–10 stages, it is possible to allow the high pressure turbine section 16 to operate at the high turbine stage efficiency.

Figure 11:
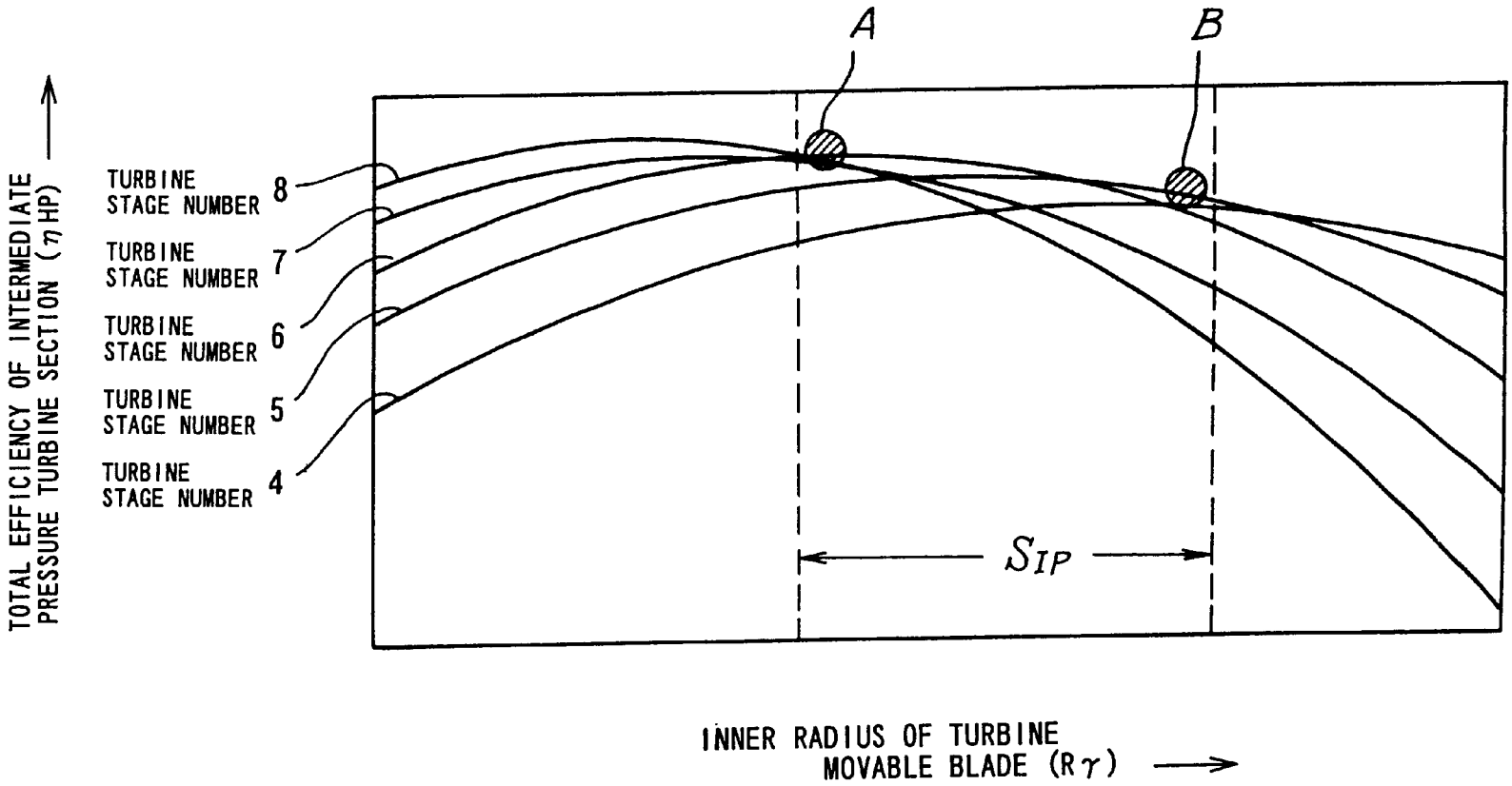
FIG. 11 is a turbine stage number selecting diagram indicating a turbine stage number from relation between the total efficiency of the intermediate pressure turbine section and the inner radius of the turbine movable blade, which is applied to the intermediate pressure turbine section of the steam turbine according to the present invention.

FIG. 11 is a turbine stage number selecting diagram for selecting the optimal number of turbine stages in the intermediate pressure turbine section of the steam turbine according to the present invention from the relationship between the total efficiency of the intermediate pressure turbine section $\eta_{IP}$ and the inner radius Rr of the turbine movable blade 34.

In a case when the number of turbine stages of the intermediate pressure turbine section 17 is selected, just as the case of the high pressure turbine section 16 as described above, the range of the inner radius Rr of the turbine movable blade 34 which can be applied to the intermediate pressure turbine section 17 is, as shown in FIG. 11, within the area $S_{IP}$.

At this time, in the case where a large number of turbine stages can be employed, the number of turbine stages is selected from the point A where the total efficiency of intermediate pressure turbine section $\eta_{IP}$ is the largest at smaller inner radius Rr of the turbine movable blade 34, that is 6–7 stages is selected.

On the other hand, in the case where it is impossible to employ such a large number of the turbine stages, the number of the turbine stages is selected from the point B where the inner radius Rr of the turbine movable blade 34 is increased and the total efficiency of intermediate pressure turbine section $\eta_{IP}$ becomes high, that is, 4–5 stages is selected.

As described above, in this fourth embodiment, since the number of the turbine stages of the intermediate pressure turbine section 17 is selected at 4–7 stages, it is possible to allow the intermediate pressure turbine section 17 to operate at the high turbine stage efficiency.

Figure 12:
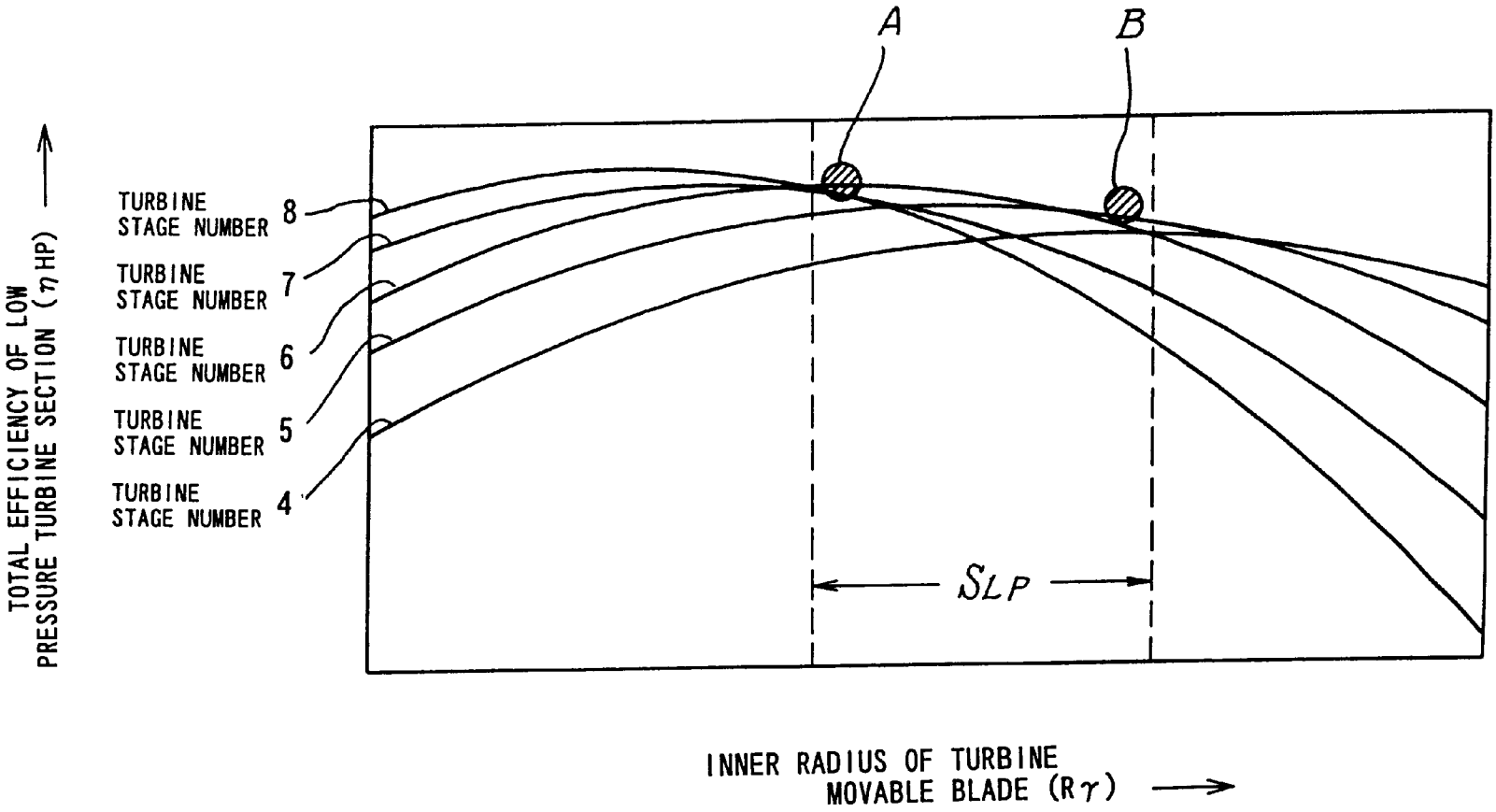
FIG. 12 is a turbine stage number selecting diagram indicating a turbine stage number from a relationship between the total efficiency of the low pressure turbine section and the inner radius of the turbine movable blade, which is applied to the low pressure turbine section of the steam turbine according to the present invention.

FIG. 12 is a turbine stage number selecting diagram for selecting the optimal number of the turbine stages in the low pressure turbine section of the turbine according to the present invention, from the relationship between a total efficiency of low pressure turbine sections $\eta_{LP}$ and the inner radius Rr of the turbine movable blade 34.

In a case when the number of the turbine stages of the low pressure turbine section 18 is selected, just as in the case of the high pressure turbine section 16 as described above, the range of the inner radius Rr of the turbine movable blade 34 which can be applied to the low pressure turbine section 18 is, as shown in FIG. 12, an area $S_{LP}$.

At this time, in the case where a large number of turbine stages can be employed, the number of turbine stages is selected from the point A where the total efficiency of low pressure turbine section $\eta_{LP}$ is the largest at the smaller inner radius Rr of the turbine movable blade 34, that is 6–7 stages is selected.

On the other hand, in the case where it is impossible to employ such a large number of turbine stages, the number of the turbine stages is selected from the point B where the inner radius Rr of the turbine movable blade 34 is increased and the total efficiency of low pressure turbine section $\eta_{LP}$ becomes high, that is, 5 stages is selected.

As described above, in this fourth embodiment, since the number of the turbine stages of the low pressure turbine section 18 is selected at 5–7 stages, it is possible to allow the low pressure turbine section 18 to operate at the high turbine stage efficiency.

Therefore, in the steam turbine according to the present embodiment which satisfies the design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, the most preferably applicable numbers of the turbine stages are: 7–10 for the high pressure turbine section 16; 4–7 for the intermediate pressure turbine section 17; and 5–7 for the number of turbine stages of the low pressure turbine section 18, for allowing the steam turbine to work at the high turbine total efficiency.

Figure 13:
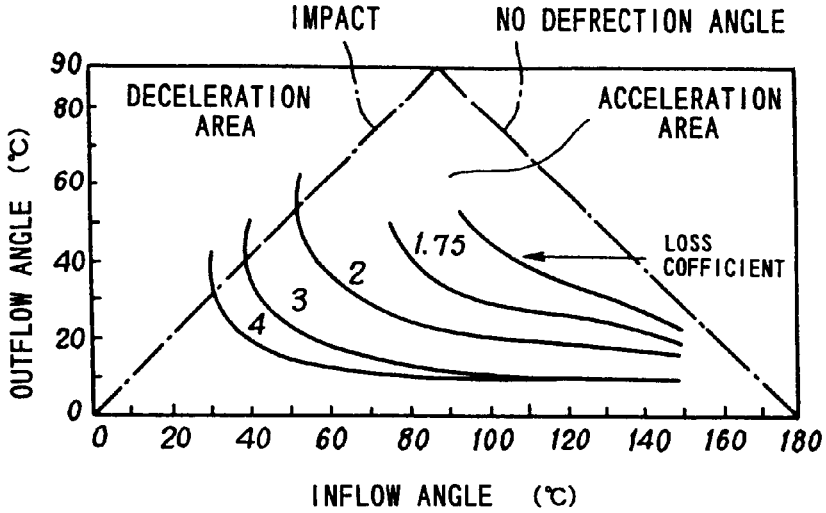
FIG. 13 is a general diagram of profile loss coefficient showing the profile loss coefficient with reference to an inflow angle and an outflow angle.
Figure 14:
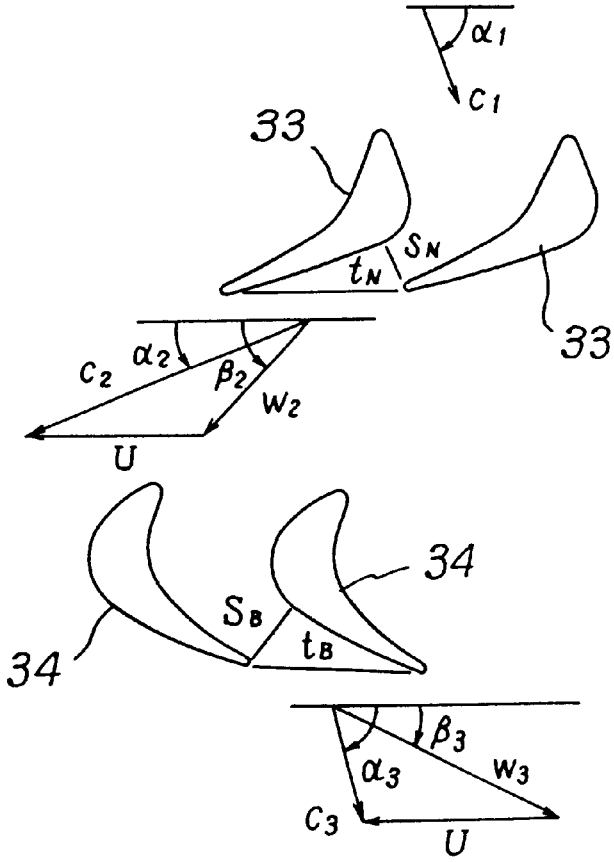
FIG. 14 is a vector diagram showing a velocity triangle at a general average radius of stage for the steam flowing in a turbine nozzle and a turbine movable blade.

FIG. 13 is a general diagram of profile loss coefficient in which the profile loss coefficient is shown with reference to inflow angle and outflow angle (Turbomachinery Society of Japan, "Steam turbine" (Japan Industrial Publishing Co. Ltd.) 1990). FIG. 14 is a vector diagram showing a velocity triangle at a general stage average radius (pitch circle radius) of the steam flowing in the turbine nozzle and turbine moving blade, in a case of providing that U is peripheral speed, C is absolute speed, W is relative speed, $\alpha$ is inflow angle, $\beta$ is outflow angle, S is throat (narrowest path portion between blades), t is blade pitch, the subscriptions 1, 2 and 3 are a turbine nozzle inlet, a turbine nozzle outlet (i.e. turbine moving blade inlet) and a turbine movable blade outlet, respectively, the subscription N represents the throat and pitch of the turbine nozzle, and the subscription B represents the throat and pitch of the turbine movable blade. In FIG. 14, since the throat/pitch (S/T) is substantially equal to the sin(outflow angle=$\alpha_2$), the outflow angle $\alpha_2$ is dealt as a $\alpha_2$=Sin$^{-1}$ (S/T) for simplification.

Conventionally, in the high pressure turbine section 16 of the high/intermediate/low pressure integrated steam turbine, for example, as shown in FIGS. 13 and 14, in the case where the inflow angle ($\alpha_1$) is close to 90°, since the profile loss coefficient is significantly increased if the outflow angle ($\alpha_2$) is set smaller than 13°, in order to prevent the profile loss coefficient from exceeding 3% when the outflow angle ($\alpha_2$) of the turbine moving blade is set at about 50°, the outflow angle ($\alpha_2$) of the turbine nozzle is set at about 15° (when the outflow angle ($\alpha_2$) is 15°, the throat/pitch ratio ($S_N/t_N$) at the average radius of turbine stage is calculated as 0.259) and the outflow angle ($\beta_3$) of the turbine movable blade is set at 24° (when the outflow angle ($\beta_3$) is 24°, the throat/pitch ratio ($S_B/t_B$) at the average radius of turbine stage is calculated as 0.406).

However, since the blade length of the high pressure turbine section 16 is as short as about 20 mm–30 mm, the secondary loss is large and thus the turbine stage efficiency is low. Incidentally, "secondary loss" is the loss generated by the flow flowing toward the back side of the blade at the boundary layer between the inner peripheral wall and the outer peripheral wall of the turbine nozzle and the turbine moving blade. It is known that in order to reduce the secondary flow, the turbine nozzle and the length of the turbine movable blade may be made longer (See "Steam Turbine (Theory and Basis)", published by SANPO-SHA, 1982).

However, in recent years, owing to the progress in analysis technologies by computers, new blade profiles in which the profile loss coefficient will not be increased even if the outflow angles ($\alpha_2$, $\beta_3$) of the turbine nozzle and the turbine movable blade are made smaller than conventional ones have been developed. Specifically, new blade profile in which outflow angle ($\alpha_2$) of the turbine nozzle can be set at 9°–12° (0.156–0.208 in terms of stroke/pitch ratio ($S_N/t_N$) at turbine stage average radius) and the outflow angle ($\beta_3$) of the turbine movable blade can be set at 16°–19° (0.276–0.326 in terms of stroke/pitch ratio ($S_B/t_B$) at the turbine stage average radius) have been developed.

Since the blade length can be as long as about 30 mm–45 mm under the same steam condition as the conventional one by employing such a profile that can reduce the outflow angels ($\alpha_2$, $\beta_3$), it is possible to reduce the secondary loss depending on increase in the blade length.

The present embodiment was made by skillfully making uses of the above-mentioned advantages, and in the high pressure turbine section 16 of the steam turbine which satisfies the design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, a profile which can set the throat/pitch ratio ($S_N/t_N$) at the average radius of the turbine nozzle 33 in the range of 0.15–0.21, and the throat/pitch ratio ($S_B/t_B$) at the average radius of the turbine movable blade 34 in the range of 0.27–0.33 is incorporated.

Therefore, according to the present embodiment, since the new blade profile which can set the throat/pitch ratio ($S_N/t_N$) at the average radius of the turbine nozzle 33 in the range of 0.15–0.21, and the throat/pitch ratio ($S_B/t_B$) at the average radius of the turbine movable blade 34 in the range of 0.27–0.33 is incorporated in the high pressure turbine section 16, it is possible to allow the high pressure turbine section 16 to operate at the high turbine stage efficiency.

Figure 15:
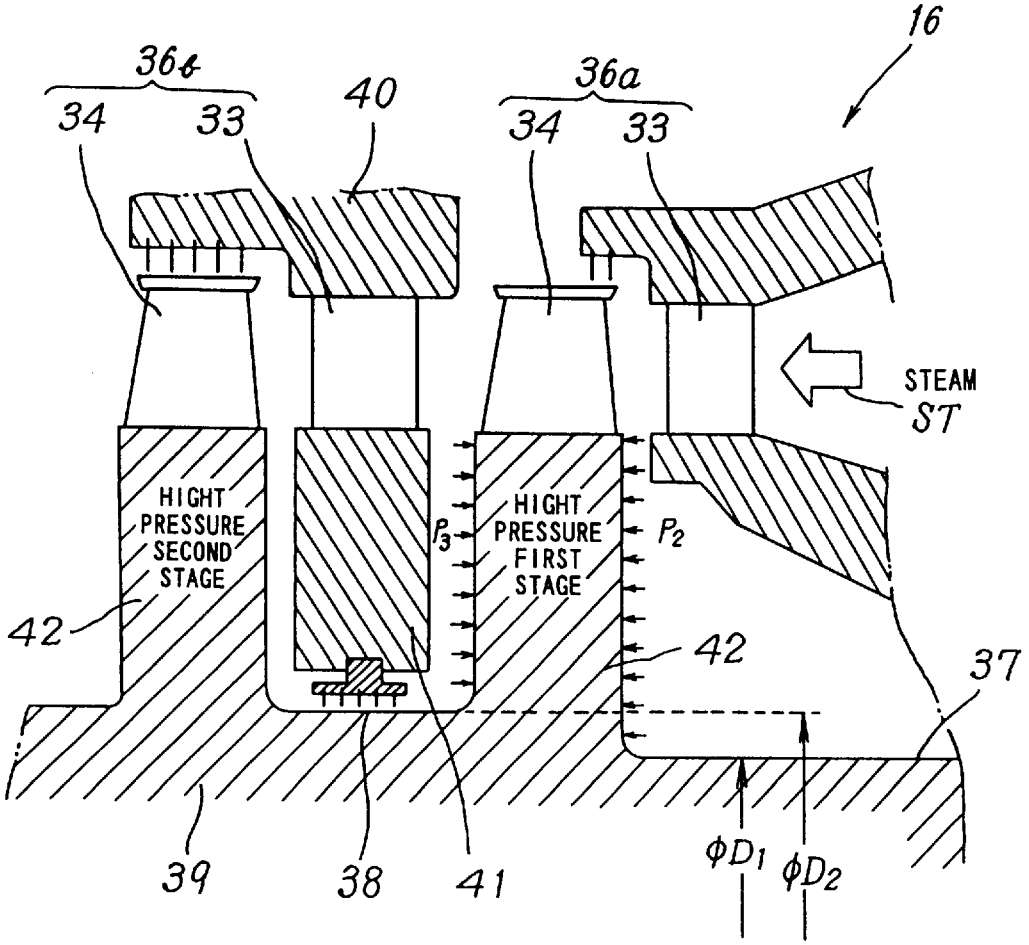
FIG. 15 is a schematic vertical sectional view partially cutaway, showing a fifth embodiment of a steam turbine according to the present invention.

FIG. 15 is a schematic vertical section view, partially cutaway, showing a fifth embodiment of the steam turbine according to the present invention.

The steam turbine according to this fifth embodiment is applied for a high pressure first stage part 36*a* of the high pressure turbine section 16, and when a diameter of a high/intermediate pressure intermediate gland part 37 is defined as $\phi D_1$ and a diameter of a gland part for second stage of high pressure turbine 38 at a high pressure second stage part 36*b* is defined as $\phi D_2$, the respective diameters$\phi D_1$, $\phi D_2$ of the gland parts 37, 38 are set to become $\phi D_1 < \phi D_2$, and a turbine rotor (turbine shaft) 39 is set so as to have a shaft radius capable of dealing with the thrust force generated during the operation.

The high pressure turbine section 16 according to the present embodiment is of the axial flow type, in which the high pressure first stage part 36*a,* the high pressure second stage part 36*b* and the like are arranged in this sequence along the direction of the steam flow ST.

Each of the high pressure first stage part 36*a* and the high pressure second stage part 36*b* has the turbine nozzle 33 and the turbine movable blade 34 in combination, which are located in an annular line along the circumferential direction of the turbine rotor 39. Further, the turbine nozzle 33 is supported at its each end by a ring-shaped diaphragm outer ring 40 and a diaphragm inner ring 41. Further, the turbine movable blade 34 is fastened in a turbine wheel 42 formed integrally with the turbine rotor 39.

In addition, the high pressure turbine section 16 according to the present embodiment is provided with an intermediate pressure turbine section, not shown, installed consecutively to the inlet side of the steam ST, as well as provided with the high/intermediate pressure intermediate gland part 37 for separating the high pressure turbine section 16 from the intermediate pressure turbine section. This high/intermediate pressure intermediate part 37 is configured to have the diameter $\phi D_1$ smaller than the diameter $\phi D_2$ of the gland part for second stage of high pressure turbine 38.

Figure 17:
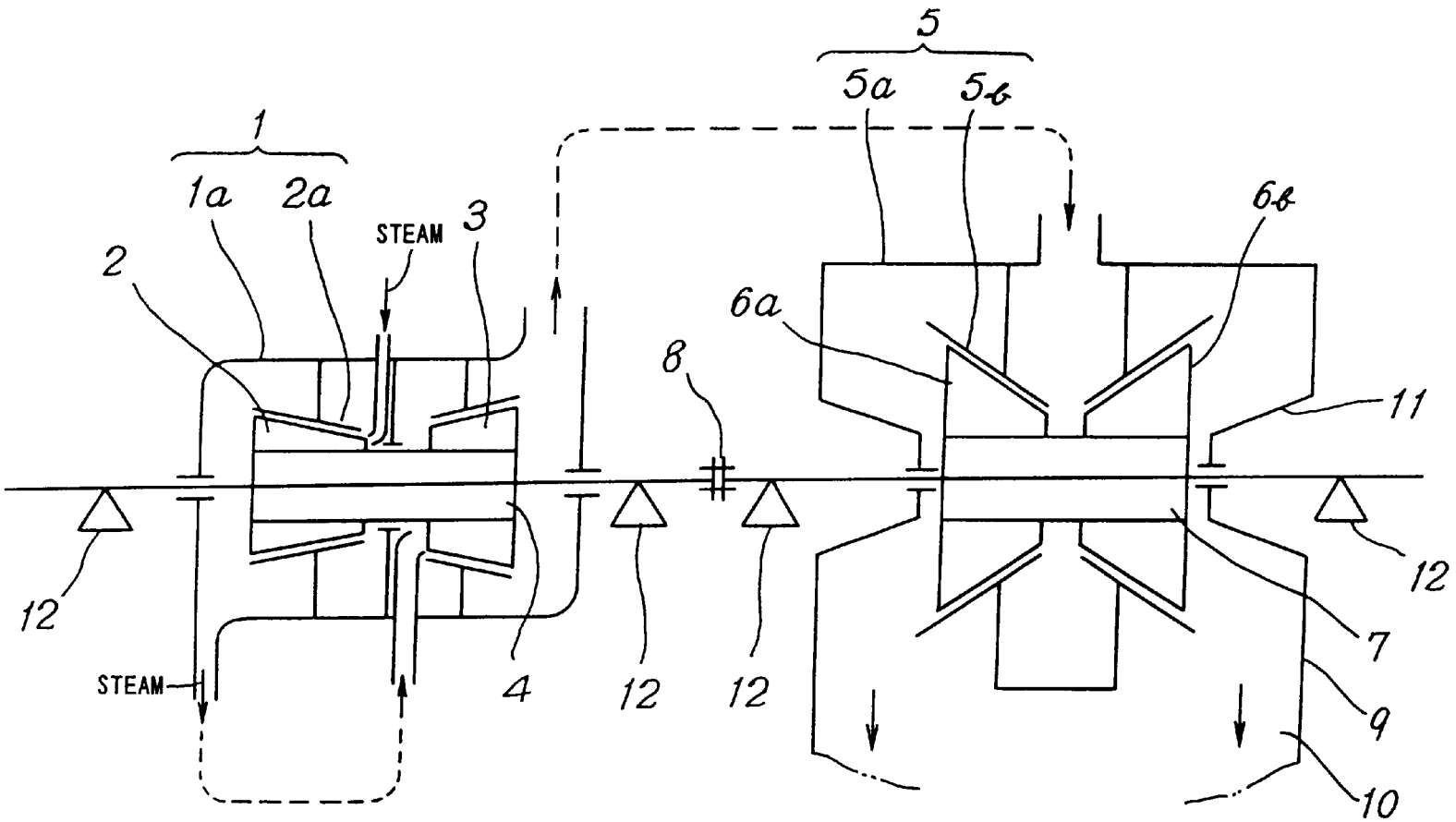
FIG. 17 PRIOR ART
FIG. 17 is a general schematic view showing a conventional steam turbine in which a high/intermediate pressure integrated type steam turbine and a double flow type steam turbine are combined.

By the way, the thrust force generated at the turbine rotor 39 is generated by the pressure difference acting on the turbine wheel 42 in which the turbine movable blade 34 is fastened, and when the pressure $P_2$ on the upstream side of the steam flow ST is larger than the pressure $P_3$ on the downstream side of the steam flow ST, the thrust force is generated in the direction which is the same as the flow direction of the steam ST. Therefore, since in the steam turbine shown in FIG. 17, the thrust forces of the low pressure turbine sections 6*a,* 6*b* are cancelled with each other because they are of the double flow type and the flow directions thereof are opposed to each other, it is necessary to set the shaft radius of the high/intermediate/low pressure integrated turbine rotor 4 considering only the thrust difference between the high pressure turbine section 2 and the intermediate pressure turbine section 3.

Figure 18:
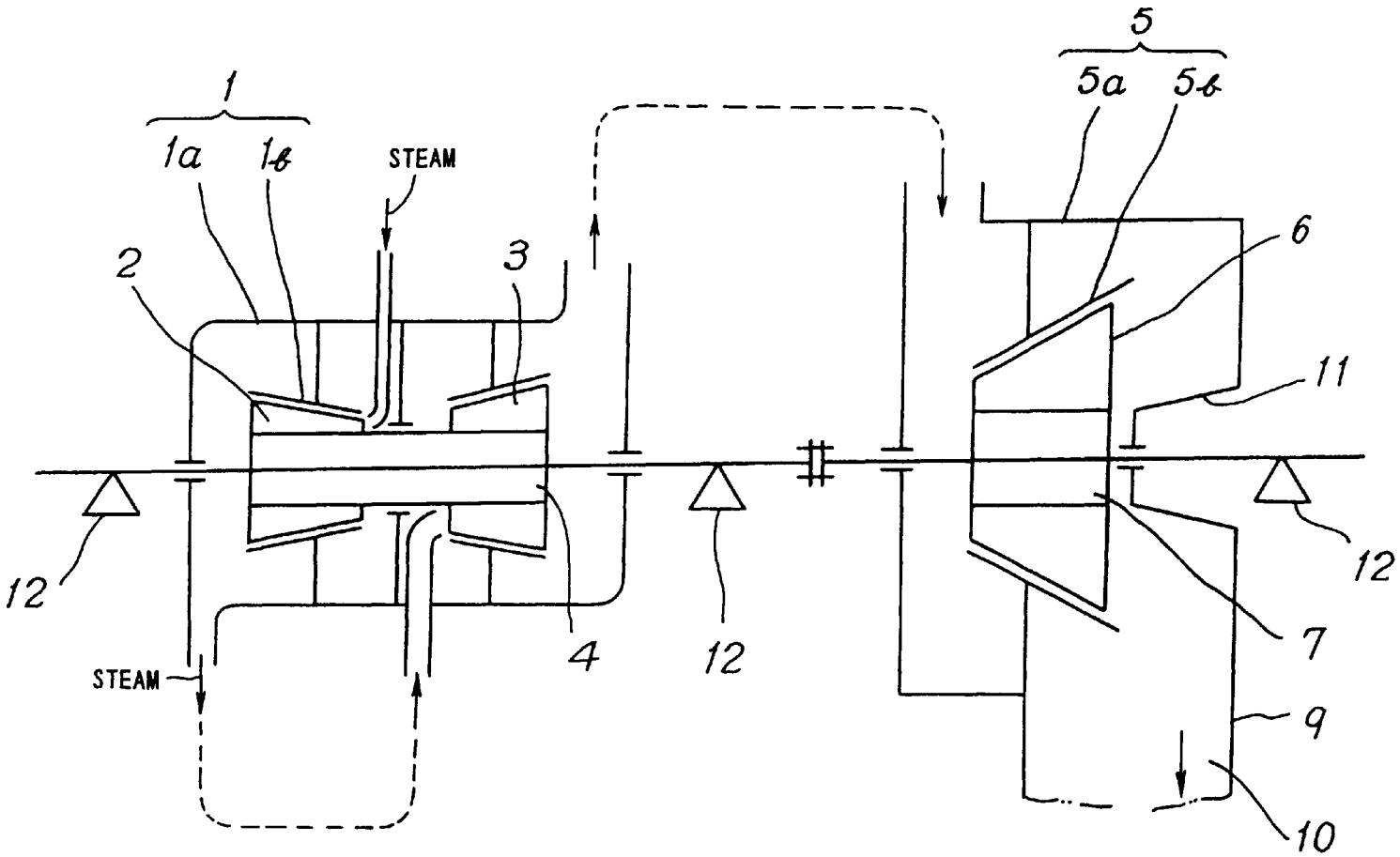
FIG. 18 PRIOR ART
FIG. 18 is a general schematic view showing a conventional steam turbine in which a high/intermediate pressure integrated type steam turbine and a single flow type steam turbine are combined.

In the case of the steam turbine in FIG. 18, however, although the high pressure turbine section 2 and the intermediate pressure turbine 3 are opposed to each other, the low pressure turbine section 6 is of the single flow, so that the thrust force acting of the low pressure turbine section 6 is directed in the same direction as that of the intermediate pressure turbine section 6. Consequently, the thrust force acting on the high/intermediate/low pressure integrated turbine rotor 4 and the whole low pressure turbine 7 equals to the solution of expression as follows:

(thrust force acting of the high pressure turbine section 16)−(thrust force acting of the intermediate pressure turbine section 17+thrust force acting on the low pressure turbine section 18), which results in that the thrust force towards the low pressure turbine section 6 is increased. In the case where the thrust force towards the low pressure turbine section 6 is increased, due consideration must be given including the increased thrust force for setting the shaft radius of the low pressure turbine rotor 7.

In particular, in the steam turbine satisfying the following design requirements: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, it will be necessary to sufficiently consider the setting of the shaft radiuses of the whole turbine rotor by taking into consideration of increase in the thrust force towards the low pressure turbine section 6 due to elongation of the last stage movable blade and the thrust bearing loss due to upsizing of the thrust bearings supporting the whole turbine rotor, as well as decrease in turbine output (power).

In the steam turbine according to this fifth embodiment, it is assumed that since by setting the diameter $\phi D_1$ of the high/intermediate pressure intermediate gland part 37 smaller than the the diameter of $\phi D_2$ of the gland part for the high pressure turbine second stage 38, the area on which the pressure $P_2$ on the upstream side of the turbine wheel 42 at the high pressure first stage part 36*a* acts is increased, the thrust force towards the high pressure side at the high pressure first stage part 36*a* is increased and thus the thrust force towards the low pressure side is decreased accordingly, so that it is possible to suppress the reduction of the turbine output. Such an assumption may be applicable to the second and third stages, for example. However, taking the effect of suppressing reduction of the turbine output into consideration, it could be applied to the high pressure first stage part 36*a* most effectively. However, if the diameter $\phi D_1$ of the high/intermediate pressure intermediate gland part 37 is set too small, a decrease in strength and vibrations of shaft will be caused.

In the present embodiment, for the steam turbine satisfying the above-mentioned design requirements, when the diameter of the high/intermediate pressure intermediate gland part 37 is defined as $\phi D_1$, and the diameter of the ground part for high pressure turbine second stage 38 is defined as $\phi D_2$, th e diameter $\phi D_1$ of the high/intermediate pressure intermediate gland part 37 is set at $$100\ D_1=(0.95 \text{ to } 0.98)\times\phi D_2.$$

The above-mentioned diameter $\phi D_1$ is a preferable application value assured by a model turbine.

As described above, in the present embodiment, since the relation between diameter $\phi D_1$ of the high/intermediate pressure intermediate gland part 37 and diameter $\phi D_2$ of the gland part for high pressure turbine second stage 38 is defined by the equation, $\phi D_1=(0.95 \text{ to } 0.98)\times\phi D_2$, it is possible to operate the steam turbine stably with respect to the thrust force generated during the operation and to suppress reduction of the turbine output during the operation thereof.

Figure 16:
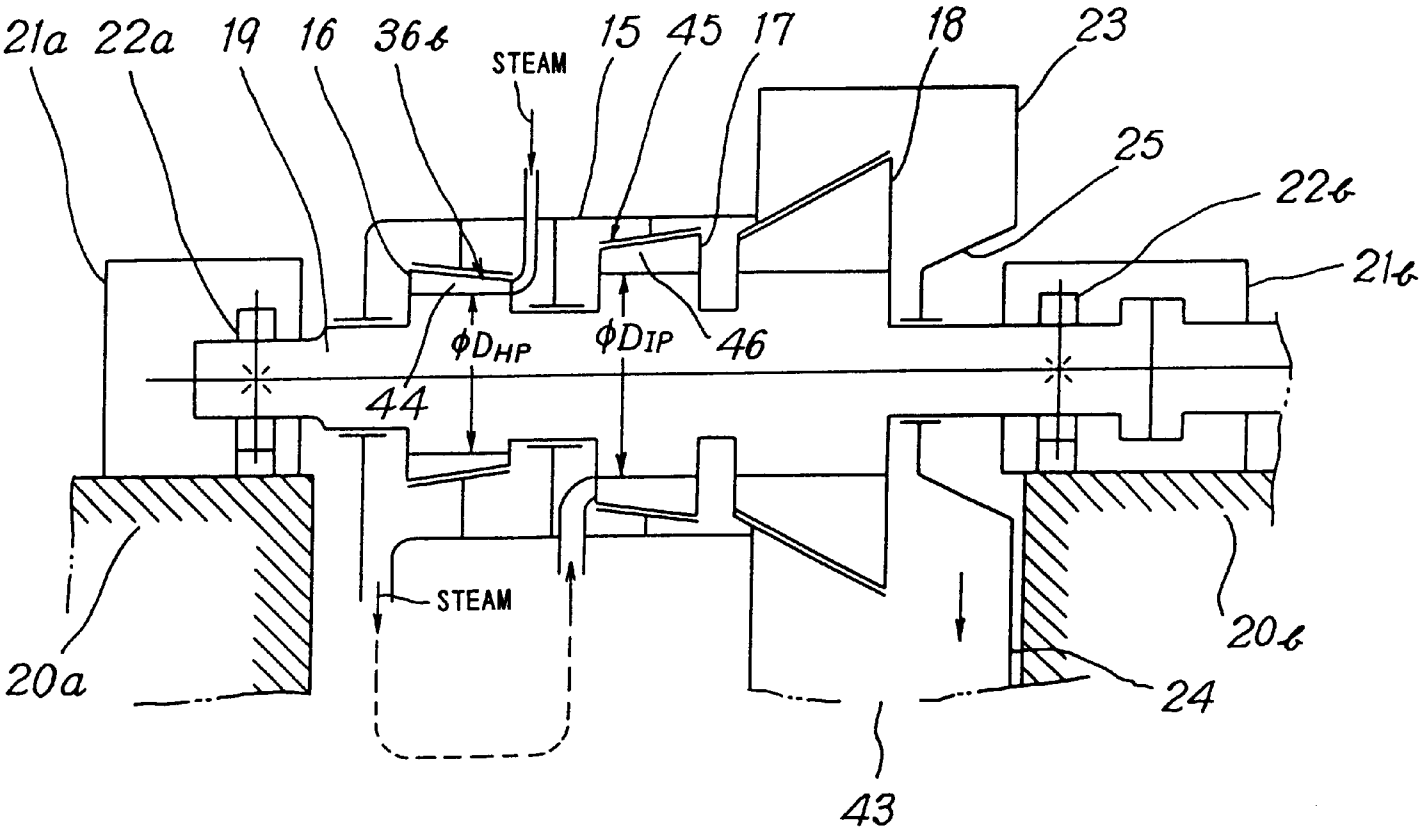
FIG. 16 is a schematic vertical sectional view showing a sixth embodiment of a steam turbine according to the present invention.

FIG. 16 is a schematic vertical sectional view showing a sixth embodiment of the steam turbine according to the present invention.

The steam turbine according to this sixth embodiment is applied, for example, for the high/intermediate/low pressure integrated type and is so configured that a high pressure turbine section 16, an intermediate pressure turbine section 17 and a low pressure turbine section 18 are accommodated in a high/intermediate/low pressure integrated turbine casing 15. A high/intermediate/low pressure integrated turbine rotor 19 has both ends, in which one end thereof on the side of the high pressure turbine section 16 is supported by a high pressure side journal bearing 22*a* accommodated in a high pressure bearing box 21*a* placed on a pedestal 20*a*, while the other end thereof on the side of the low pressure turbine section 18 is supported by a high pressure side journal bearing 22*b* accommodated in a high pressure bearing box 21*b* placed on a pedestal 20*b*.

Further, in the steam turbine according to the present embodiment, an opening 43 of the turbine exhaust hood 23 characteristic to so-called the downward exhausting type is provided on the downstream side of the high/intermediate/low pressure integrated turbine casing 15, and a connecting body wall 24 for connecting the recess portion 25 with the condenser is provided on the bottom side of the same. The recess portion 25 is formed into a conical shape on the low pressure side journal bearing 22 of the turbine exhaust hood 23.

In the steam turbine according to the present embodiment having the configuration mentioned above, when the inner diameter of a steam path 44 in the high pressure second stage part 36*b* of the high pressure turbine section 16 is defined as $\phi D_{HP}$, and the inner diameter of a steam path 46 in an intermediate pressure first stage 45 of the intermediate pressure turbine section 17 is defined as $\phi D_{IP}$, ratio of the inner diameters ($\phi D_{IP}/\phi D_{HP}$) is set in the range of:

$$1.2\leqq\phi D_{IP}/\phi D_{HP}\leqq 1.5.$$

In the steam turbine according to the present embodiment satisfying the the following design requirements: a main steam pressure of 100 kg/cm$^2$ or more; a main steam temperature of 500° C. or more; a rated output (power) of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, upon completion of expansion work at the high pressure turbine section 16, steam temperature drops to 360° C., and the specific volume at that time is increased four times as high as that at the time of the operation starting.

Furthermore, the steam having exited from the high pressure turbine section 16 is again heated to be equal to or more than 500° C., and the specific volume at that time is increased 1.4 times as high as that at the exit of the high pressure turbine section 16. However, since partial steam extraction from the high pressure turbine section 16 is effected, the volume flow at the time of flowing in the steam path 46 of the intermediate pressure first stage part 45 in the intermediate pressure turbine section 17 is triple as high as that at the time of flowing in the steam path 44 of the high pressure second stage part 36*b* in the high pressure turbine section 16.

In addition, the main steam pressure of the steam flowing in the high pressure turbine section 16 is equal to or more than 100 kg/cm$^2$, whereas the main steam pressure of the steam flowing in intermediate pressure turbine section 17 is several tens kg/cm$^2$, so that even if the pressure ratios between the back and forth of the turbine blade array are equal with each other, the difference in pressure can be reduced to a fraction of that of the high pressure turbine section 16. Accordingly, the blade length of the intermediate first stage part 45 in the intermediate pressure turbine section 17 can be made 2–2.5 times as long as that of the high pressure second stage part 36*b* in the high pressure turbine section 16.

Therefore, in the present embodiment, since the blade is designed so that the axial flow speed is constant along the radial direction (direction of blade length), it is preferable to set the inner diameter ratio of $\phi D_{IP}/\phi D_{HP}$ between the inner diameter $\phi D_{HP}$ of the steam path 44 of the high pressure second stage part 36*b* in the high pressure turbine section 16 and the inner peripheral diameter $\phi D_{IP}$ of the steam path 46 of the intermediate pressure first stage part 45 in the intermediate pressure section 17 in the range of:

$$1.2 \leqq \phi D_{IP}/\phi D_{HP} \leqq 1.5.$$

As described above, in this sixth embodiment, since the ratio of inner diameter $\phi D_{IP}/\phi D_{HP}$ is set in the range of $1.2 \leqq \phi D_{IP}/\phi D_{HP} \leqq 1.5$, it is possible to operate the steam turbine while keeping high the turbine stage efficiency.

As described above, according to the various embodiments of the present invention, it becomes possible to produce a large amount of work per one turbine state as well as allowing stable operation thereof by shortening the bearing span.

It is to be noted that the present invention is not limited to the described preferred embodiments and many other changes and modifications may be made without departing from the scopes of the appended claims.

What is claimed is:

1. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein a turbine exhaust chamber of the low pressure turbine section has a structure extending towards both sides of a transverse direction of the turbine casing.

2. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein a turbine exhaust chamber of the low pressure turbine section has a structure extending towards the upper side of the turbine casing.

3. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein a turbine exhaust chamber of the low pressure turbine section has a structure extending in the axial direction thereof.

4. A steam turbine according to claim 3, wherein the turbine exhaust chamber is provided with a spreading path defined by an outer peripheral wall and an inner peripheral wall thereof and the inner peripheral wall is formed with a conical recess portion for installing a journal bearing.

5. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein when a throat area of a turbine nozzle is defined as $A_N$, and a throat area of a turbine movable blade is defined as $A_B$ in the high pressure turbine section, a ratio of the two throat areas ($A_B/A_N$) is set within a range of:

$$1.6 \leqq A_B/A_N \leqq 1.8.$$

6. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein an inner radius of a turbine movable blade in a turbine stage of the high pressure turbine section is gradually increased along a direction of a steam flow and when the inner radius of the turbine movable blade is defined as Rr, and an inner radius of a turbine movable blade in the next stage of the high pressure turbine is defined as Rrn, a ratio of the two radiuses (Rrn/Rn) is set within a range of:

$$1 < Rrn/Rr \leqq 1.05.$$

7. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein an inner radius of a turbine movable blade in a turbine stage of the intermediate pressure turbine section is gradually increased along a direction of a steam flow and when the inner radius of the turbine movable blade is defined as Rr, and inner peripheral radius of a turbine movable blade in the next stage of the intermediate pressure turbine is defined as Rrn, a ratio of the two radiuses (Rrn/Rn) is set within a range of:

$$1<Rrn/Rr\leqq 1.1.$$

8. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein the number of turbine stages of the high pressure turbine section is set to 7–10, the number of turbine stages of the intermediate pressure turbine section is set to 4–7 and the number of turbine stages of the low pressure turbine section is set to 5–7.

9. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein a throat/pitch ratio ($S_N/t_N$) at an average radius of a turbine nozzle of the high pressure turbine section is set within a range of:

$$S_N/t_N=0.15 \text{ to } 0.21,$$

while a throat/pitch ratio ($S_B/t_B$) at an average radius of the turbine movable blade of the high pressure turbine section is set within a range of:

$$S_B/t_B=0.27 \text{ to } 0.33.$$

10. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more; or a unit rotated at a rotation speed of 3,600 rpm equipped with a last-stage movable blade of the turbine having an effective blade length of 33.5 inches or more, wherein a direction of a steam flow through turbine stages of the high pressure turbine section and the direction of the steam flow through turbine stages of the intermediate pressure turbine section are opposed to each other, and when a diameter of a high/intermediate pressure intermediate gland part defining the high pressure turbine section and the intermediate pressure turbine section is defined as $\phi D_1$ and a diameter of a high pressure turbine second stage gland part of the high pressure turbine section is defined as $\phi D_2$, the diameter $\phi D_1$ of the high/intermediate pressure intermediate gland part is set within a range of:

$$\phi D_1=(0.95 \text{ to } 0.98)\times\phi D_2.$$

11. A steam turbine which comprises, in combination, at least two of a high pressure turbine section, an intermediate pressure turbine section and a low pressure turbine section in a single turbine casing and which satisfies design requirements of: a main steam pressure of 100 kg/cm$^2$ or more; a main steam temperature of 500° C. or more; a rated output of 100 MW or more; and a unit rotated at a rotation speed of 3,000 rpm equipped with a last-stage movable blade of the turbine having an effective blade length of 36 inches or more, or a unit rotated at a rotation speed of 3,600 rpm equipped with a last-stage movable blade of the turbine having an effective blade length of 33.5 inches or more, wherein when an inner peripheral diameter of a steam path in a high pressure second stage part of the high pressure turbine section is defined as $\phi D_{HP}$, and inner peripheral diameter of a steam path in an intermediate pressure first stage part of the intermediate pressure turbine section is defined as $\phi D_{IP}$, the ratio of the two inner peripheral diameters ($\phi D_{IP}/\phi D_{HP}$) is set within the range of:

$$1.2\leqq\phi D_{IP}/\phi D_{HP}\leqq 1.5.$$

* * * * *